US006019209A

United States Patent [19]

Hara et al.

[11] Patent Number: 6,019,209

[45] Date of Patent: Feb. 1, 2000

[54] MEDIUM-RESERVING APPARATUS FOR RECEIVING AND RESERVING INDIVIDUALLY TRANSFERRED MEDIA AND DISCHARGING RESERVED MEDIA IN A BATCH

[75] Inventors: Toshio Hara; Hiroharu Yamamoto; Isao Kidokoro; Mamoru Yamagata; Katumi Ooe, all of Nagano; Tetuji Kawasaki, Tokyo; Kazuya Nakayama, Tokyo; Yukihiro Takano, Tokyo; Tatuhiko Sonehara, Nagano; Takanori Yamada, Tokyo, all of Japan

[73] Assignee: Fuji Electric Co., Ltd., Kawasaki, Japan

[21] Appl. No.: 09/053,622

[22] Filed: Apr. 2, 1998

[30] Foreign Application Priority Data

Apr. 8, 1997 [JP] Japan ..... 9-089024
Sep. 8, 1997 [JP] Japan ..... 9-242898

[51] Int. Cl.[7] ..... G07F 7/04; B65H 29/40; B65H 31/00; B65H 29/20

[52] U.S. Cl. ..... 194/206; 271/178; 271/315; 271/209

[58] Field of Search ..... 194/206, 207; 271/177, 178, 315, 187, 209

[56] References Cited

U.S. PATENT DOCUMENTS 4,537,390 8/1985 Kiamco et al. ..... 271/315
4,930,977 6/1990 Beeman et al. ..... 271/187
5,476,256 12/1995 Fortuna et al. ..... 271/315
5,518,230 5/1996 Scarlata et al. ..... 271/187
5,620,177 4/1997 Takemoto et al. ..... 271/315

FOREIGN PATENT DOCUMENTS 8-310672 11/1996 Japan .
2 301 092 11/1996 United Kingdom .

*Primary Examiner*—Robert P. Olszewski
*Assistant Examiner*—Bryan Jaketic
*Attorney, Agent, or Firm*—Kanesaka & Takeuchi

[57] ABSTRACT

A medium or bill reserving apparatus of the invention receives and reserves at least one individually transferred medium or bill, and discharges the reserved media in a batch. The apparatus is formed of an accumulating wheel having an outer surface and a groove portion opened in the outer surface to receive a tip of the medium for holding. The accumulating wheel is rotated from a medium standby position to a medium release position. A clamper is formed in the accumulating wheel to clamp the tip of the medium introduced into the groove portion and to release the medium at the medium release position, and a medium-accumulating section is formed outside the accumulating wheel for accumulating the medium released at the medium-release position.

24 Claims, 19 Drawing Sheets

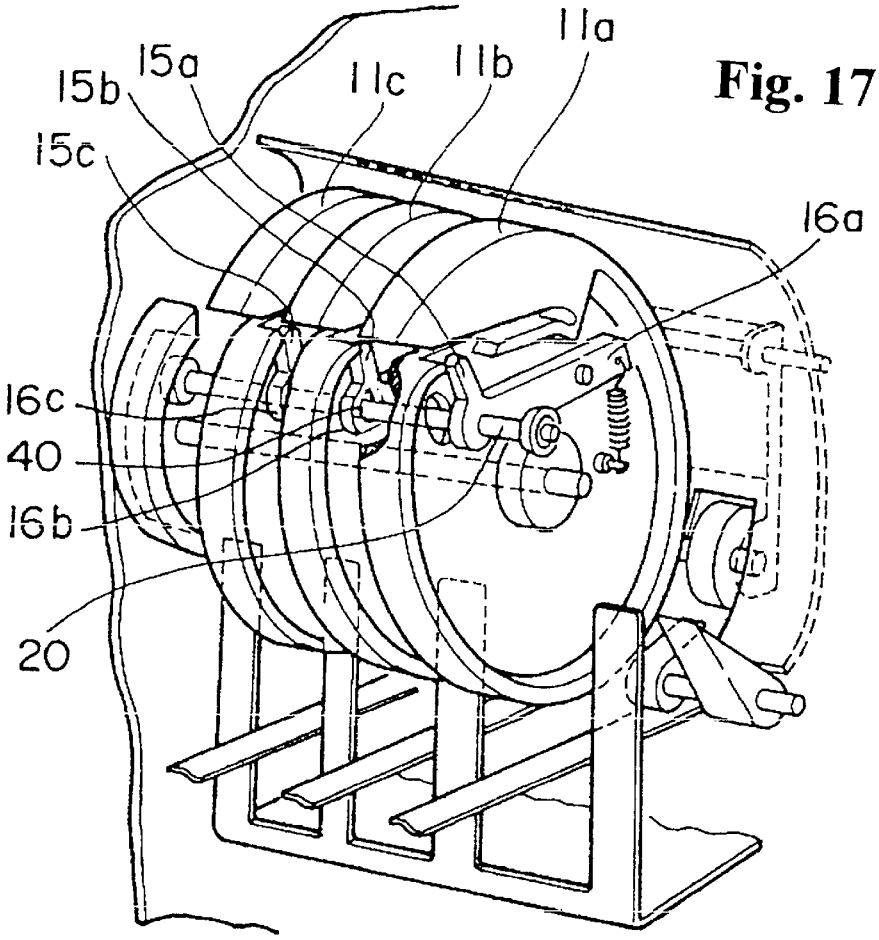
Fig. 17
Fig. 18
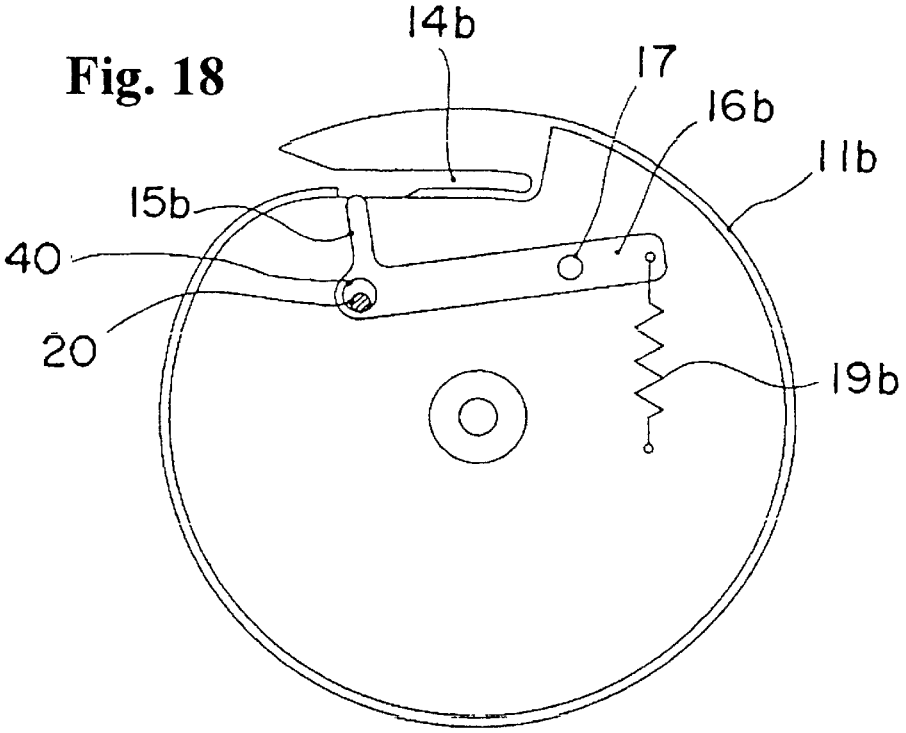

MEDIUM-RESERVING APPARATUS FOR RECEIVING AND RESERVING INDIVIDUALLY TRANSFERRED MEDIA AND DISCHARGING RESERVED MEDIA IN A BATCH

BACKGROUND OF THE INVENTION AND RELATED ART STATEMENT

The present invention relates to a medium-reserving apparatus, and in particular to a medium-reserving apparatus preferably applied to a medium transaction apparatus that can sequentially transfer or deliver paper-like media such as bills, temporarily align and accumulate them inside the apparatus, and hold inside the apparatus the temporarily reserved media or return them in response to an instruction from a higher level.

Bill input machines for paying bills are known. A bill input machine generally includes an input-money separating section for taking bills inputted through a bill input slot in a batch and sequentially separating and delivering them; an input-money discriminating section for determining in a transfer path whether each separated bill is genuine and whether the separation and transfer condition is appropriate, i.e. overlapping or sending bills in series; a branching section for separating inappropriate bills and placing them in an input-bill return path, or permitting the bills to enter a bill temporary storage path if the bills include no inappropriate one; and a temporary storage device that temporarily accumulates the bills to return them in a batch or house them in a housing.

The temporary storage device used in such a bill input machine has, for example, the structure shown in FIGS. 24, 25, 26(*a*) and 26(*b*)

FIG. 24 is a schematic explanatory drawing showing an example of a conventional temporary storage device. The illustrated temporary storage device is called the accumulating wheel method and is composed of an accumulating wheel 102 around which a plurality of blades 101 is installed; a transfer roller 104 that feeds bills 103 into the accumulating wheel 102; a transfer belt 105 provided under the accumulating wheel 102; a bill stopper 106 that extracts bills from the accumulating wheel 102; and a belt 107 used to transfer the accumulated bills in a batch.

The accumulating wheel 102 rotates clockwise. A bill 103 transferred in the width direction by the transfer roller 104 is fed between the blades 101 and transferred to the bill stopper 106 while being held therebetween. When the tip of the bill 103 reaches the bill stopper 106, the bill 103 is removed from between the blades 101 and dropped onto the transfer belt 105. The top of the transfer belt 105 constitutes a bill accumulating section on which the transferred bills 103 are sequentially accumulated. The belt 107 is moved in the direction indicated by the arrow in the figure to press down on the temporarily accumulated bills, which are then transferred while being sandwiched between the belt 107 and the transfer belt 105.

FIG. 25 is a schematic explanatory drawing showing another example of a conventional temporary storage device. The illustrated temporary storage device is known as the impeller method and is composed of a transfer roller 112 around which a plurality of blades 111 is installed; a transfer roller 113 that cooperates with the transfer roller 112 in transferring bills to the inside of the temporary storage device; a belt 114 used to transfer the accumulated bills in a batch; a stage 116 that can be moved in the vertical direction and has transfer rollers 115*a*, 115*b* and 115*c*; and a bill presser 118 that is located in an accumulating section 117 formed between the belt 114 and the stage 116, the free end of which presses down on the top of the stage 116 due to its own weight.

A bill transferred in the longitudinal direction by the transfer rollers 112 and 113 is fed into the accumulating section 117 formed between the belt 114 and the stage 116. At this point, the tip of the bill slides between the bill presser 118 and the stage 116. Once the bill has passed between the transfer rollers 112 and 113, its rear end is struck downward by the blade 111. Thus, the rear end of the bill is constantly pressed downwardly to maintain a space on the accumulated bills in order to prevent the tip of the next bill entering the storage device from colliding against the rear end of the accumulated bills. Upon completion of the accumulation of the bills, the stage 116 rises to press the accumulated bills against the belt 114. The belt 114 is then driven to transfer in a batch the bills sandwiched between the stage 116 and the belt 114.

FIGS. 26(A) and 26(B) are schematic explanatory drawings showing yet another example of a conventional temporary storage device. FIG. 26(A) shows a view from the direction in which bills are transferred, and FIG. 26(B) shows a view from the direction perpendicular to FIG. 26 (A). The illustrated temporary storage device is called the pusher method and is composed of a pusher 121 that moves back and forth in the vertical direction; a transfer belt 122 that transfers bills; a bill receiver 124 constituting a bill housing section 123 for sequentially housing the transferred bills; a transfer belt 126 constituting a bill accumulating section 125 under the bill housing section 123; and a stage 127 that can move in the vertical direction.

When the bills are to be accumulated, the stage 127 has been moved upwardly and stopped immediately below the bill receiver 124. When sequentially transferred by the transfer roller 122 from the direction indicated by the arrow 128 while the pusher 121 is located in an upward position, bills are housed in the bill housing section 123 in such a way that both of their lateral side edges in the transfer direction are received by the bill receiver 124. The bills housed in the bill housing section 123 are pressed downwardly by the pusher 121 and into the bill accumulating section 125 via an opening in the middle of the bill housing section 123, and are then accumulated on the transfer belt 126. The pusher 121 is then raised to its original position to wait for the next bill accumulating operation. By repeating this operation, the transferred bills are sequentially accumulated in the bill accumulating section 125 by the pusher 121. Once a predetermined accumulation has been reached, the stage 127 moves downwardly to the top of the accumulated bills to sandwich the bills between the stage 127 and the transfer belt 126. The belt 126 is then driven to transfer the accumulated bills in a batch.

In the conventional temporary storage devices, in regard to the accumulating wheel method, a bill is inserted between the blades of the accumulating wheel and is transferred while being held between the blades by frictional force. Thus, bills may not be correctly inserted between the blades or may slip out from between the blades and fail to be accumulated at the correct position. In particular, worn-out bills or bills that can no longer be smooth, which are susceptible to buckling and can not be pushed between the blades correctly, may fail to be transferred to the accumulating position correctly.

In addition, in the impeller method, since bills are transferred in such a way that a new bill slides over the surface of the accumulated bills, if the accumulated top bill has a fold in its corner, the new bill will collide with the fold and be prevented from being transferred or accumulated. Furthermore, there are some countries where significantly different sized bills are used. If a short bill is inputted, the blade may fail to strike the rear end of the bill. Thus, if any bill is accumulated with its rear end bent upward due to the failure to strike it, the next bill will collide against it and be prevented from being accumulated correctly.

Furthermore, since the pusher method uses the reciprocating motion of the pusher to sequentially feed into the accumulating section the bills inputted into the housing section, quick accumulation is impossible and a large installation space is required due to the inclusion of the housing and accumulating sections and the reciprocating motion of the pusher, thereby preventing a reduction in size.

This invention has been made in view of these points, and the object is to provide a medium-reserving apparatus that can reliably receive and accumulate media such as bills, even worn-out bills, bills with folded corners, or bills that differ significantly in size.

SUMMARY OF THE INVENTION

This invention provides a medium-reserving apparatus that receives and reserves at least one individually transferred medium and later discharges reserved media in a batch. The apparatus comprises a drum-like accumulating wheel having a groove portion that is opened in its outer surface so as to correspond to a medium input position when the wheel is in a medium standby position and receives a tip of the medium, with the accumulating wheel being installed so as to rotate from the medium standby position to a medium release position; a clamper section that clamps the tip of the medium introduced into the groove portion and releases at the medium release position; and a medium-accumulating section for accumulating the media that are released in the medium release position.

According to the structure of the invention, when the medium is inputted, its tip is introduced into the groove portion of the accumulating wheel, which is standing in the medium standby position. The tip of the medium introduced into the groove portion is gripped by the clamper section. When the accumulating wheel is rotated while the tip of the medium is gripped, the medium is drawn into the medium-accumulating section with its tip in the front side. The accumulating wheel draws the tip of the medium to the medium-accumulating section while allowing the clamper to grip it, thereby preventing the tip from being blocked during transfer for the accumulation. The medium is thus reliably transferred to the medium release position. When the clamper section releases the tip of the medium in the medium release position, the transfer of the medium by the accumulating wheel is completed to leave the medium in the medium-accumulating section. The next medium is similarly drawn into the medium-accumulating section while its tip is gripped, and is then released in the medium release position. Thus, this medium remains in the medium release position and contacts the media accumulated earlier. Therefore, the media pile up and align in the medium-accumulating section.

BRIEF DESCRIPTION OF THE DRAWINGS

FIG. 17 is a partially cut perspective view of a temporary reserving section according to a fourth embodiment;

FIG. 18 is a side view showing the bill accumulation standby state of the accumulating wheel located in the middle of the temporary reserving section of the fourth embodiment;

FIGS. 26(A) and 26(B) are schematic explanatory drawings showing yet another example of a conventional temporary storage device, wherein FIG. 26(A) is a view as seen from the direction in which bills are transferred, and FIG. 26(B) is a view as seen perpendicularly to FIG. 26(A).

DETAILED DESCRIPTION OF PREFERRED EMBODIMENTS

Embodiments of this invention are described below in conjunction with its application to a temporary storage device for a bill input machine.

Figure 4:
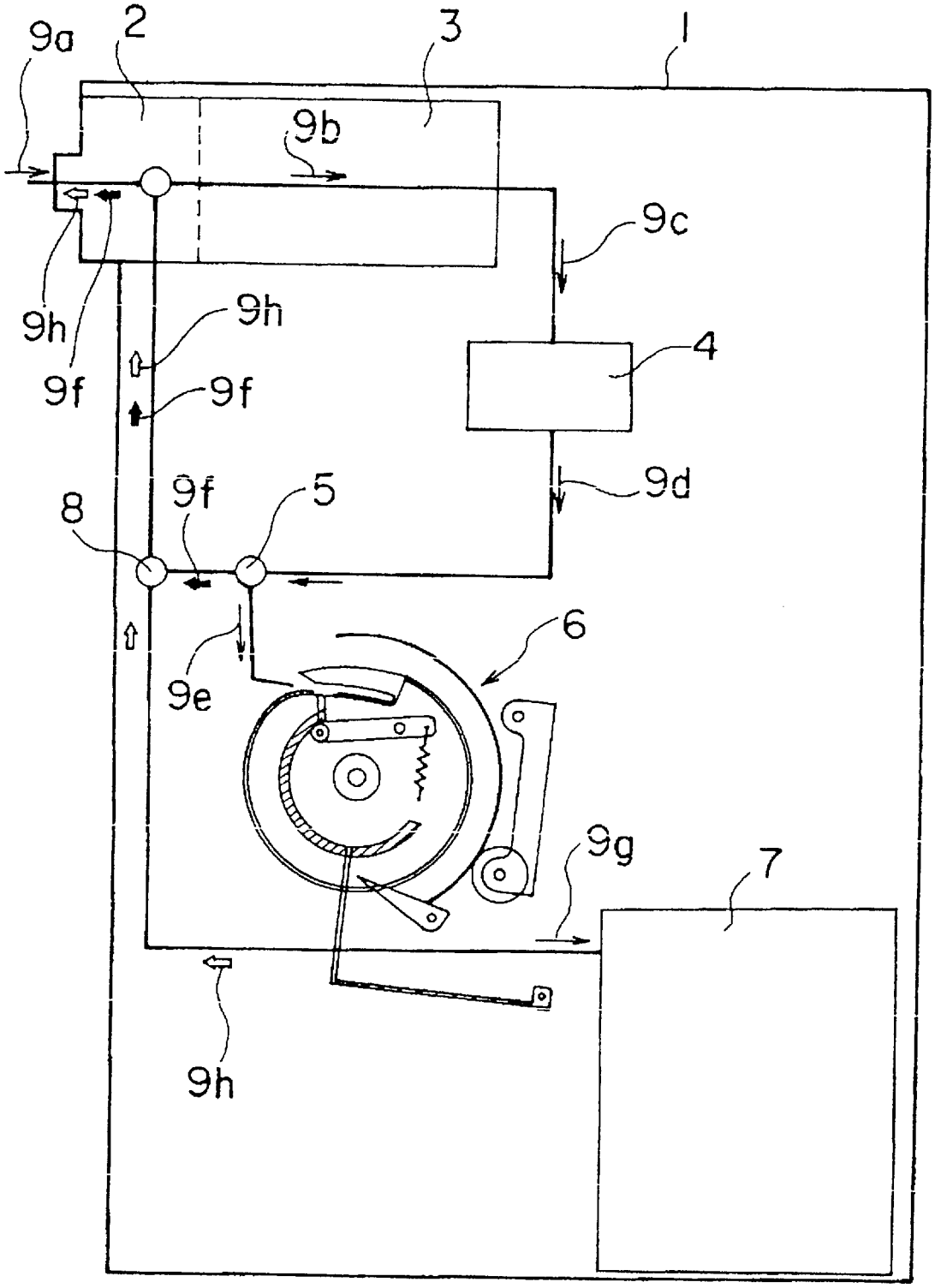
FIG. 4 shows a general configuration of a bill input machine.

FIG. 4 shows a general structure of a bill input machine. In this figure, a bill input machine 1 is composed of an input and return section 2, at which at least one bill is inputted and returned; a separating section 3 for separating multiple bills mutually and delivering them; a discriminating section 4 for determining the types of the bills and their transfer condition; a branching section 5 for switching a bill transfer path based on the results of the determination by the discriminating section 4; a temporary reserving section 6 for accumulating the bills; a bill housing 7 for housing the bills; and a merging section 8 in which the bills returned from the branching section 5 and temporary reserving section 6 are merged.

The operation of the bill input machine 1 of the above structure is described mainly along the flow of bills. When one or more bills are inputted into the input and return section 2 (arrow 9*a*), they are transferred to the separating section 3 in a batch (arrow 9*b*). The separating section 3 separates each of the multiple bills and sequentially delivers them to the discriminating section 4 (arrow 9*c*). The discriminating section determines the types of the bills; counts the number of the bills in each bill type; determines whether each bill is genuine and whether the separation and transfer condition is appropriate; and outputs the bills for which the determination has been completed (arrow 9*d*). The branching section 5 switches the transfer path according to the result of the determination by the discriminating section 4. If the result of the determination is positive, the branching section switches the transfer path to the direction in which the bills are permitted to enter the temporary reserving section 6 (arrow 9*e*), whereas if the result is negative, it switches the transfer path to the direction in which the bills pass through the merging section 8 (arrow 9*f*). The bills sent to the merging section 8 are transferred to the input and return section 2.

The bills transferred to the temporary reserving section 6 are sequentially aligned and accumulated. Once a predetermined accumulation has been reached, the accumulated bills are outputted in a batch. Subsequently, the bill transfer direction is determined according to the user's confirmation. That is, if a housing instruction is issued, the bills outputted in a batch are transferred to the bill housing 7 in a batch and housed therein (arrow 9*g*), whereas if a return instruction is issued, the bills outputted in a batch are directed toward the merging section 8 and transferred to the input and return section 2 (arrow 9*h*).

Next, a temporary reserving section according to a first embodiment of this invention is described in detail with reference to FIGS. 1 to 3.

Figure 1:
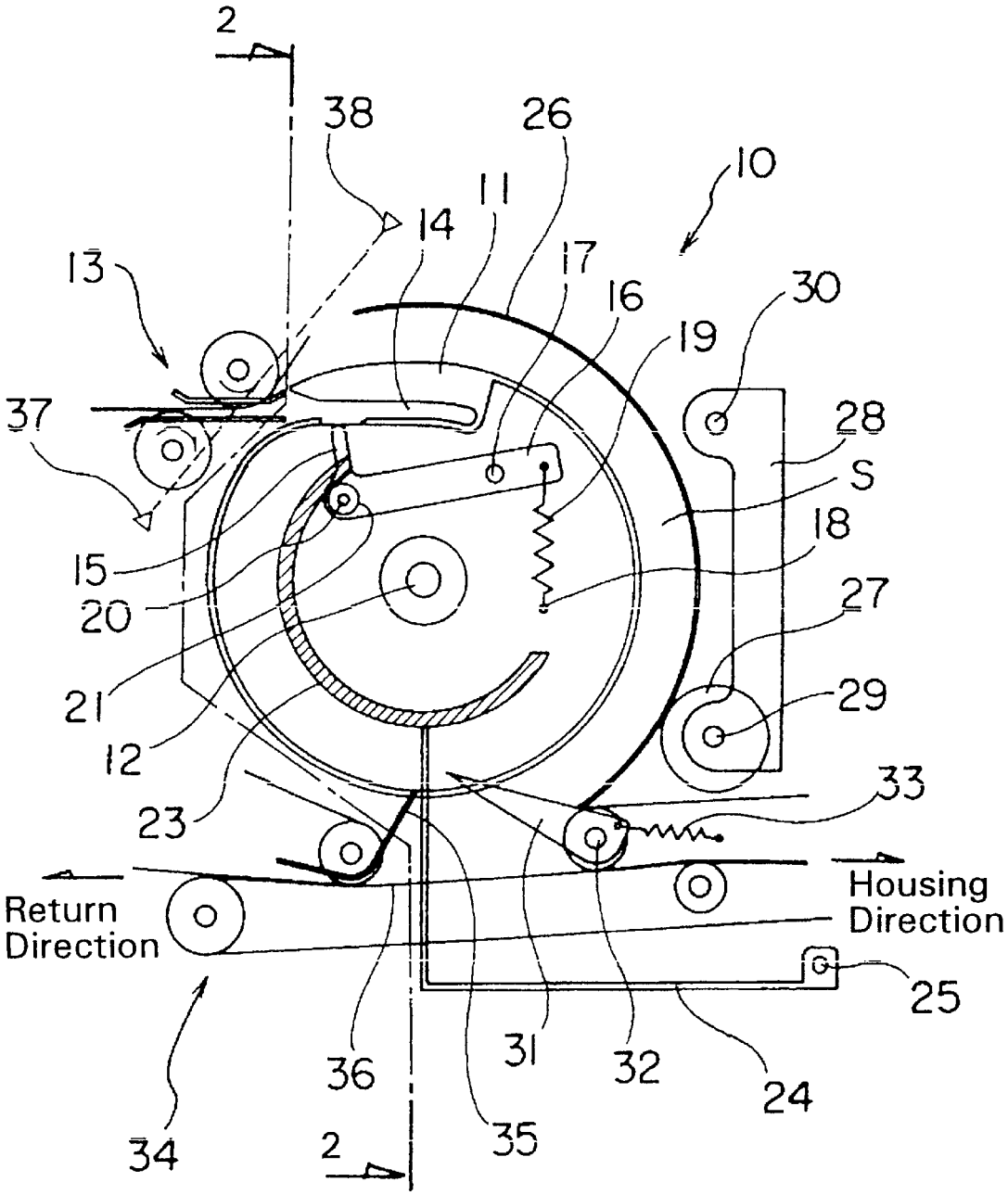
FIG. 1 is a side sectional view of a temporary reserving section of a bill input machine of the invention.
Figure 2:
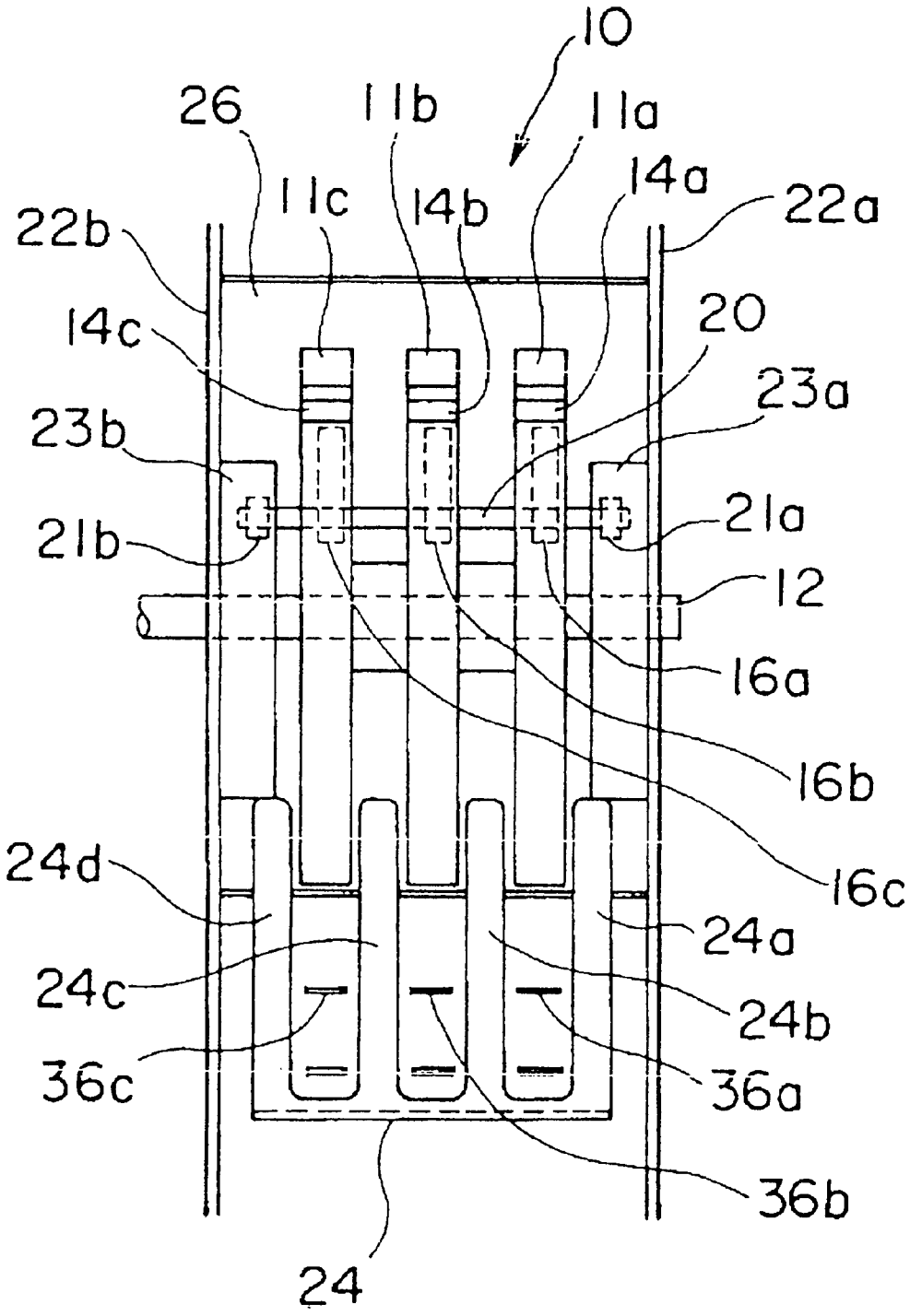
FIG. 2 is a vertical sectional view taken along line 2—2 in FIG. 1.
Figure 3:
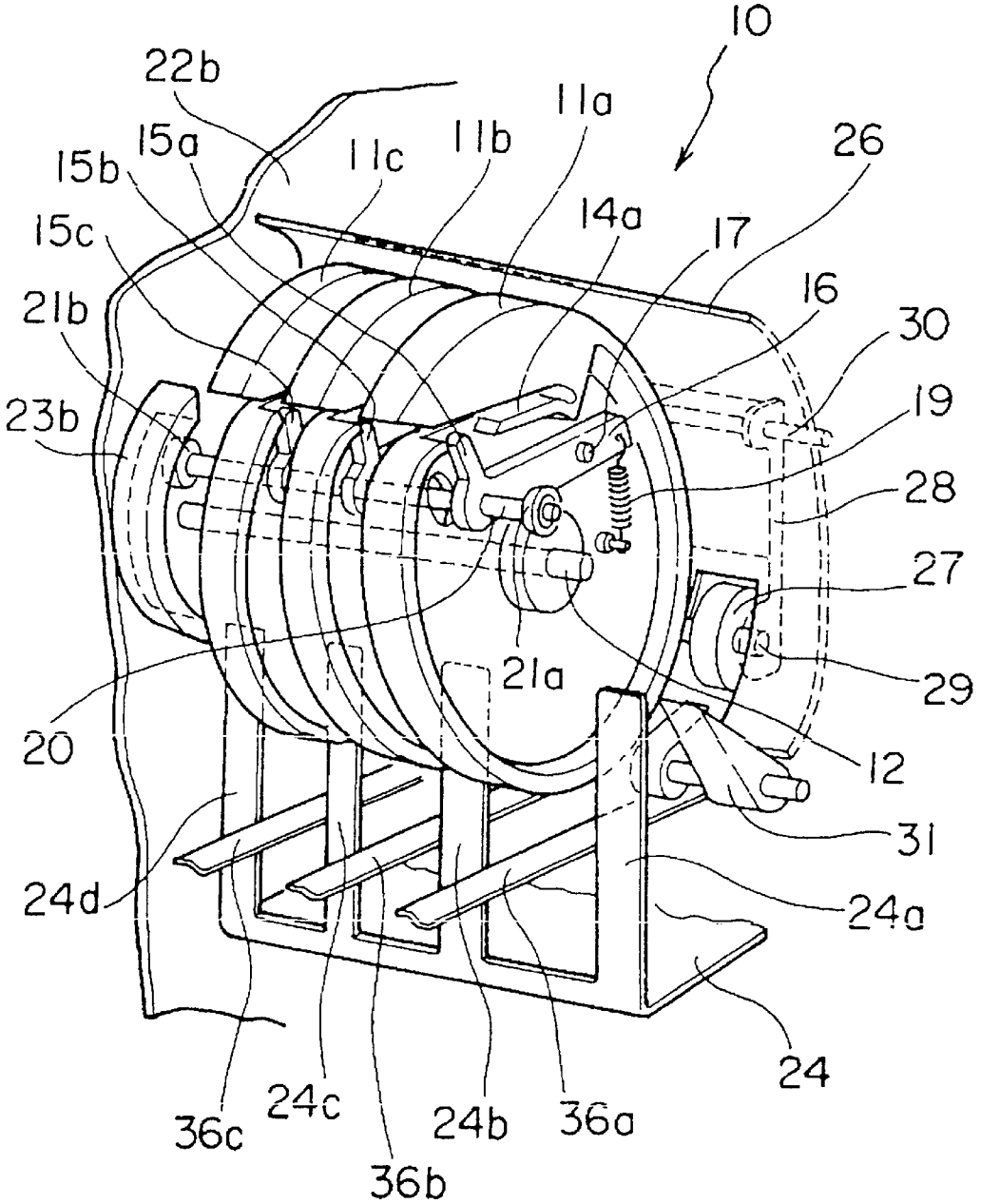
FIG. 3 is a partially cut perspective view of the temporary reserving section.

FIG. 1 is a side sectional view of the temporary reserving section, FIG. 2 is a vertical sectional view taken along line 2—2 in FIG. 1, and FIG. 3 is a partially cut perspective view of the temporary reserving section.

The temporary reserving section 10 has in its middle a drum-like accumulating wheel 11 that is rotationally driven around a rotating shaft 12 by a motor (not shown). The accumulating wheel 11 has a circumferential length longer than the longest side of the bills to be processed. According to the present embodiment, the temporary reserving section 10 has three accumulating wheels 11*a*, 11*b* and 11*c* fixed to the rotating shaft 12, as shown in FIGS. 2 and 3. Since bills are of various widths and may be bent if they are transferred while being gripped at only one position, the three accumulating wheels 11*a*, 11*b* and 11*c* are used to grip the tip of an inputted bill at at least two positions, even if they are narrow. If a description common to the three accumulating wheels 11*a*, 11*b* and 11*c* is provided, they are simply referred to as the accumulating wheel 11. Other components are explained similarly.

A bill input section 13 is provided to the upper left of the accumulating wheel 11 in proximity thereto, as shown in FIG. 1. The bill input section 13 comprises a roller, belt, or guide plate, and transfers bills in the horizontal direction from the left in the figure. A groove 14 (indicated as 14*a* 14*b* and 14*c* in FIG. 2) is provided in the outer circumferential portion of the accumulating wheel 11 so as to correspond to the position at which bills are inputted from the bill input section 13. The depth or extending direction of the groove 14 is aligned with the direction in which the bills are inputted in order to receive the tip of the inputted bill in a straight manner. The accumulating wheel 11 has the largest radius at the position of the outer circumferential surface at which the groove 14 is situated, with the radius gradually decreasing from this position in the clockwise direction, and the outer circumferential surface is finally connected to the lower end of the opening.

One side end surface of the accumulating wheel 11 is recessed, and a mechanism for clamping the tip of a bill is provided in the space formed in this recessed portion. An arm 16 with a protruding clamper 15 formed at one end is supported via a supporting shaft 17 so as to oscillate or swing. A tension spring 19 is positioned at the other end of the arm 16 so as to extend between this end and a shaft 18, and the spring force is applied to rotate the arm 16 around the supporting shaft 17 in the clockwise direction, as shown in FIG. 1. The tip of the clamper 15 enters and leaves the space inside the groove 14 in the accumulating wheel 11 as the arm 16 oscillates.

In addition, a connection shaft 20 is fixed to the arm 16 near the root of the clamper 15. The connection shaft 20 penetrates through holes drilled at the corresponding positions of the accumulating wheels 11*a* to 11*c* to connect to the arms 16*a* to 16*c*, as shown in FIG. 2. Rollers 21*a* and 21*b* are rotatably supported near the respective ends of the connecting shaft 20. As shown in FIGS. 2 and 3, cams 23*a* and 23*b* with a circular arc shape are fixed to the inner wall surfaces of side plates 22*a* and 22*b*, respectively, which support the temporary reserving section 10. The cams 23*a* and 23*b* engage the rollers 21*a* and 21*b* in a predetermined range of rotation angles of the accumulating wheel 11, thereby allowing the clamper 15 to leave the inside of the groove 14.

A stopper 24 is provided under the accumulating wheel 11. The stopper 24 regulates the movements of the reserved bills and is L-shaped, wherein a portion extending upward from the horizontal portion is formed of comb-like regulating sections 24*a* to 24*d*. The regulating sections 24*a* to 24*d* are formed so as to enter between the accumulating wheels and between the accumulating wheel and the side plate, as shown in FIGS. 2 and 3, with their tips being located above the trace of the groove 14 associated with the rotation of the accumulating wheel 11. The stopper is supported by a supporting shaft 25 so as to oscillate and is driven by an actuator (not shown).

A guide plate 26 is provided at the right side of the accumulating wheel 11 shown in FIG. 1, and with a predetermined interval from the outer circumferential surface of the accumulating wheel 11. The guide plate 26 is formed like a circular arc concentric with the accumulating wheel 11, with both edges in the lateral direction being fixed to the side plates 22*a* and 22*b*. Thus, the guide plate 26, the outer circumferential surface of the accumulating wheel 11, the side plates 22*a* and 22*b*, and the regulating sections 24*a* to 24*d* of the stopper 24 form a reserving space S for the bills.

25 Behind the guide plate 26, that is, at the right side of FIG. 1, a presser roller 27 is rotatably supported by a shaft 29 fixed to a supporting plate 28. Furthermore, the supporting plate 28 is supported by a supporting shaft 30 provided between the side plates 22*a* and 22*b* so that the supporting plate can oscillate or swing. A notch is formed in the guide plate 26 at a position corresponding to the accumulating wheel 11, as shown in FIG. 3, so that an actuator (not shown) is used to drive the supporting plate 28 to cause the presser roller 27 to enter the reserving space S via the notch in order to impose pressure on the outer circumferential surface of the accumulating wheel 11.

A gate 31 is provided near the lower end of the guide plate 26, supported by a shaft 32 so as to oscillate or swing, and urged clockwise by the spring force of a tension spring 33. The tip of the gate 31 is normally limited by the lower end of the guide plate 26 and stops inside the outer circumference of the accumulating wheel 11. The gate 31 gently presses the bills in the reserving space S for alignment while the bills are accumulated, and prevents the bills from entering the reserving space S when the receive/return transfer section 34, which is described below, transfers the bills transferred from the reserving space S in a batch to a bill housing, the installation location of which is shown at the right side of the figure.

The receive/return transfer section 34, which is provided under the accumulating wheel 11, transfers the bills reserved in the reserving space S and is composed of a guide plate 35 that introduces the reserved bills, a plurality of belts 36 (indicated as 36*a*, 36*b* and 36*c* in FIGS. 2 and 3), and a plurality of rollers. The bill housing 7 is installed at the right side of the receive/return transfer section 34 while the input and return section 2 is installed at its left side, so that the receive/return transfer section 34 can transfer the reserved bills to either of them according to an instruction.

A sensor is provided between the bill input section 13 and the accumulating wheel 11 for detecting whether the bill input section 13 has introduced bills into the groove 14 in the accumulating wheel 11. The sensor is composed of an emission section 37 provided under the bill input section 13 and a light-receiving section 38 provided near the upper edge of the guide plate 26. The sensor detects that a bill is being inputted when an optical path from the emission section 37 to the light-receiving section 38 is blocked by the bill, and determines, after the predetermined length of time has passed from this point based on the transfer speed of the bill input section 13, that the tip of the bill passes the clamper 15 and is introduced into the groove 14.

Next, the bill accumulating, bill reserving, and bill transfer operations in the temporary reserving section 10 are described. The accumulating and reserving operations in the temporary reserving section 10 are first described with reference to FIGS. 5 to 11. In these figures, only the elements related to the description of the operations have reference numerals and arrows indicating operational directions.

Figure 5:
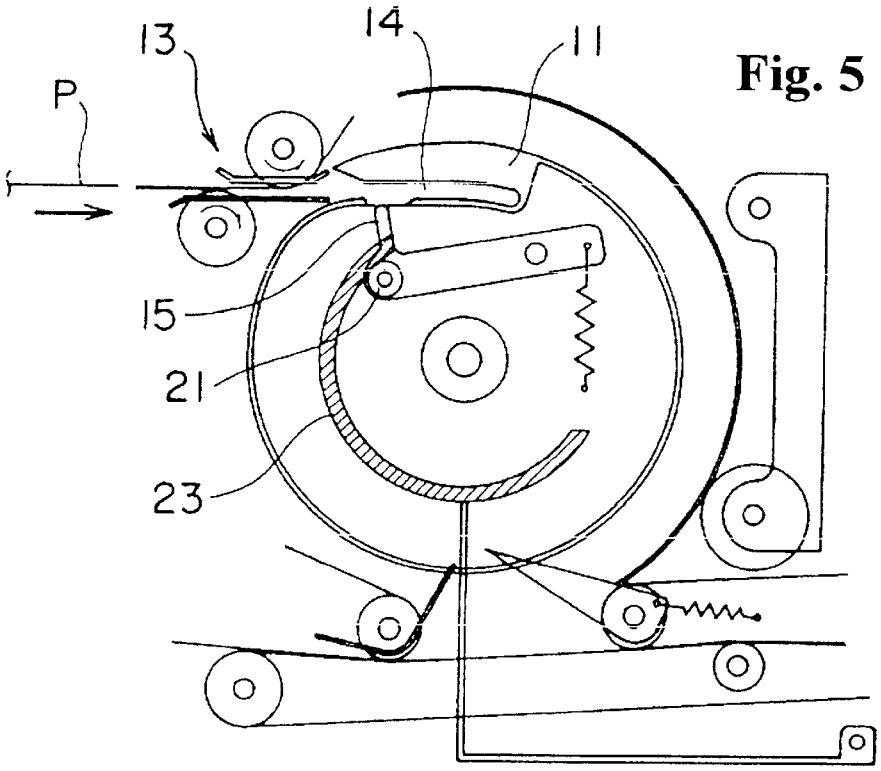
FIG. 5 is a side sectional view showing the bill accumulation standby state of the temporary reserving section.

FIG. 5 is a side sectional view showing a bill-accumulating standby state in the temporary reserving section. In this figure, a bill P determined to be normal by the discriminating section 4 is transferred from the left by the bill input section 13. At this point, the accumulating wheel 11 is stationary in an illustrated rotational position in which the groove 14 faces the bill input section 13, and the roller 21 rides on the cam 23 to allow the clamper 15 to leave the groove, i.e not located inside the groove 14.

Figure 6:
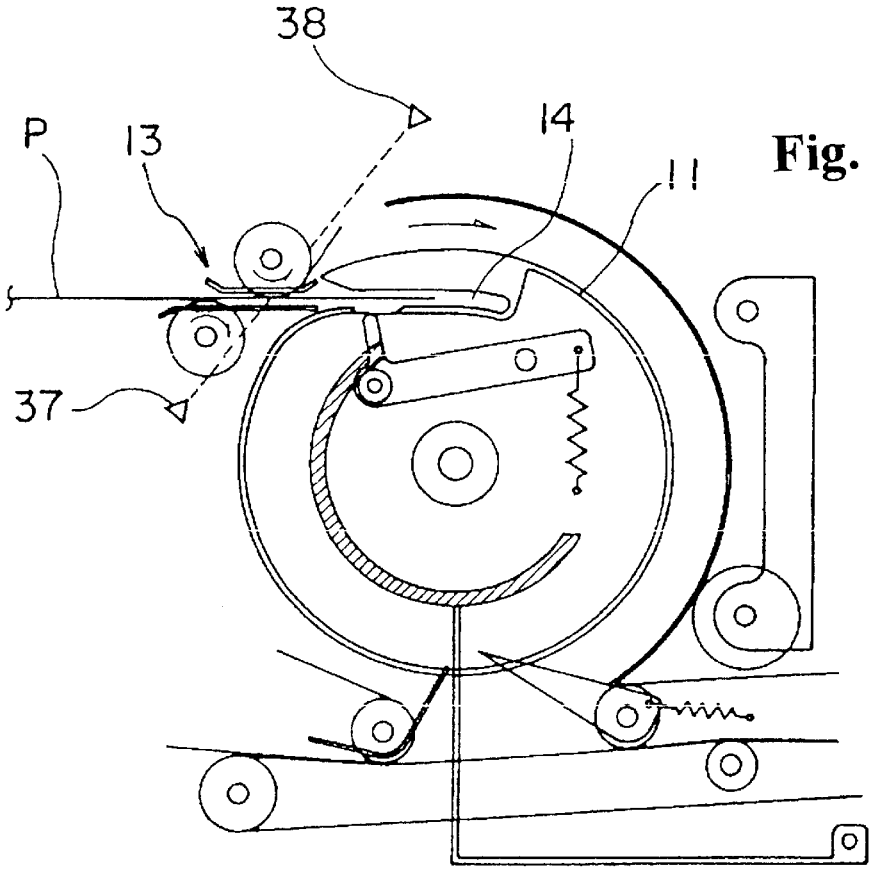
FIG. 6 is a side sectional view showing a bill carried into a groove in an accumulating wheel.

FIG. 6 is a side sectional view showing a bill carried into the groove in the accumulating wheel. In this figure, the bill P is carried into the groove 14 of the accumulating wheel 11 by the bill input section 13, and at this point, light emitted by the emission section 37 and received by the light-receiving section 38 is blocked by the bill P, enabling the input of the bill P to be detected. After a predetermined length of time has passed after the detection, that is, once the tip of the bill P has advanced beyond the clamper 15, a motor (not shown) begins to rotate the accumulating wheel 11 clockwise, as shown in the figure.

Figure 7:
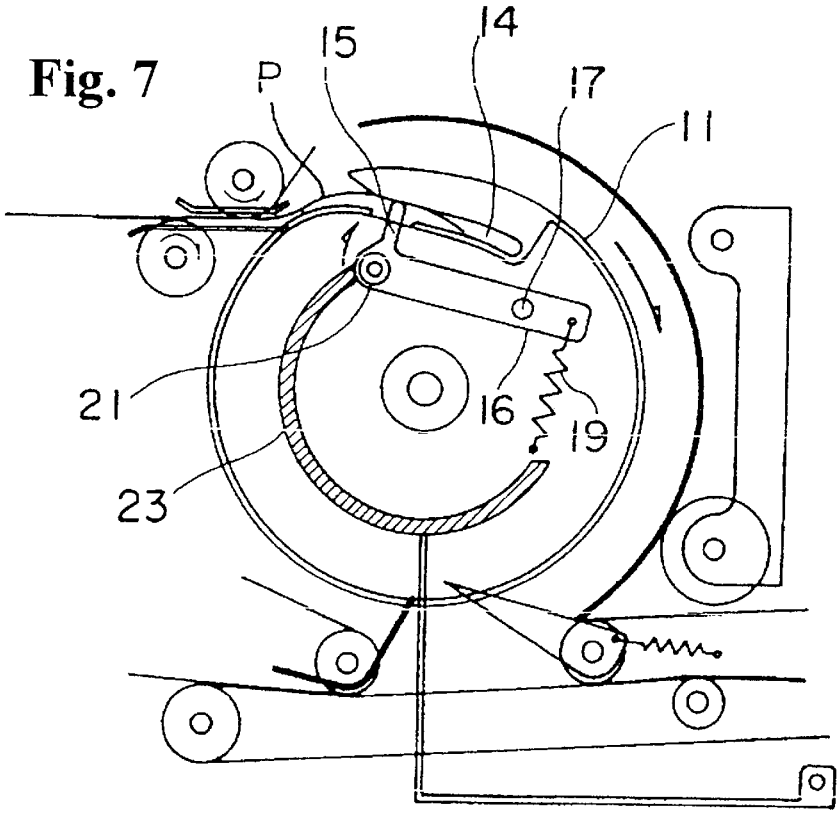
FIG. 7 is a side sectional view showing a clamped bill.

FIG. 7 is a side sectional view showing the clamped bill. In this figure, when the accumulating wheel 11 is rotated to cause the roller 21 to leave the cam 23, the arm 16 rotates clockwise around the supporting shaft 17 due to the urging force of the tension spring 19, thereby causing the clamper 15 to enter the groove 14. Thus, the bill located in the groove 14 is gripped by the upper inner wall of the groove 14 and the clamper 15, and transferred integrally with the rotating accumulating wheel 11. To prevent the bill from slipping out of the clamper 15, the circumferential speed of the outer circumference of the accumulating wheel 11 is set equal to or somewhat lower than the transfer speed of the bill input section 13. Thus, despite possible flexure during transfer, the bill is not pulled between the bill input section 13 and the clamper 15 and is thus prevented from slipping out of the damper 15 or being damaged. According to this embodiment, the outer circumferential speed of the accumulating wheel 11 is set 5% lower than the transfer speed of the bill input section 13.

Figure 8:
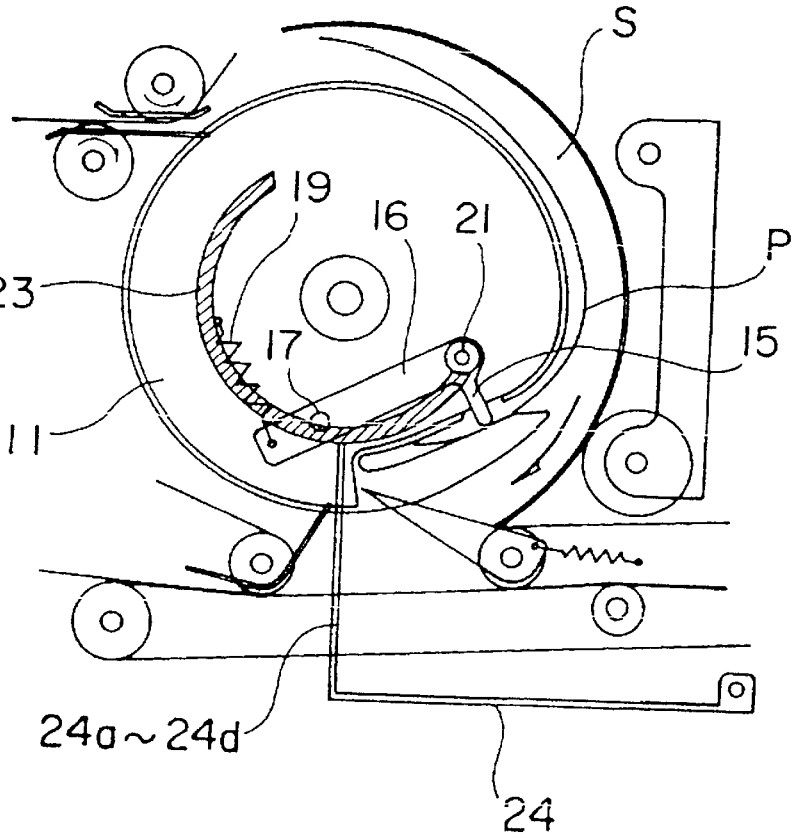
FIG. 8 is a side sectional view showing the state immediately before the bill is released from clamping.

FIG. 8 is a side sectional view showing the state immediately before the bill is released from the clamp. In this figure, when the accumulating wheel 11 is further rotated to cause the tip of the bill P gripped by the clamper to approach the regulating sections 24*a* to 24*d* of the stopper 24, the roller 21 again contacts the cam 23. The roller 21 then runs onto the cam 23 to cause the arm 16 to be rotated counterclockwise around the supporting shaft 17 against the tension force of the tension spring 19.

Figure 9:
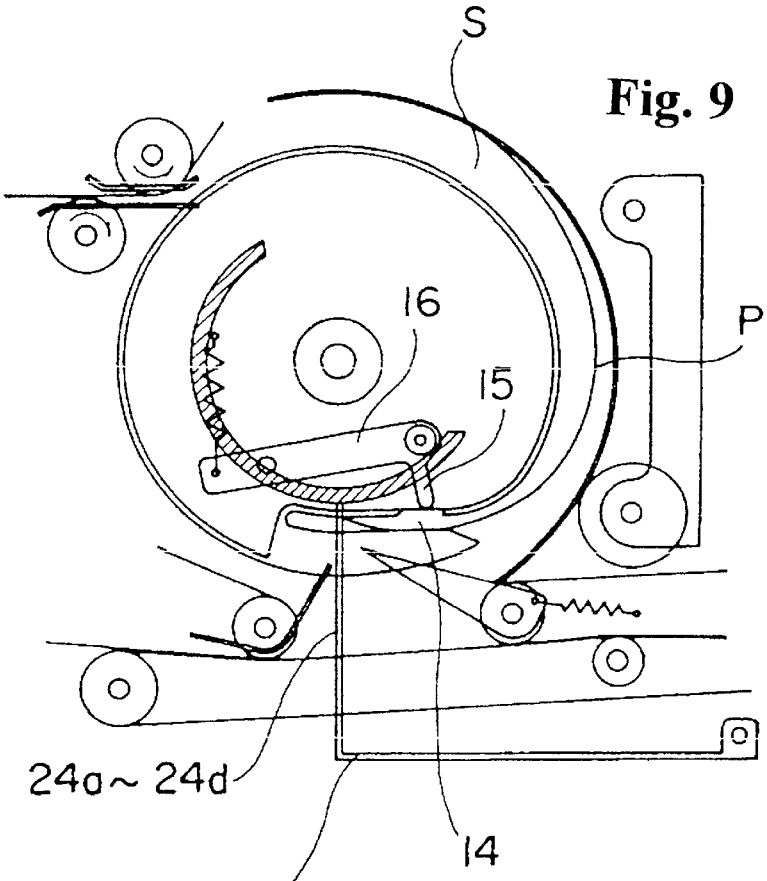
FIG. 9 is a side sectional view showing the bill regulated by a stopper.

FIG. 9 is a side sectional view showing the bill regulated by the stopper. In this figure, since the counterclockwise rotation of the arm 16 causes the clamper 15 to leave the inside of the groove 14, the bill P is released from the clamper 15. The released bill P has its movement limited by the regulating sections 24*a* to 24*d* of the stopper 24 and remains in the reserving space S.

Figure 10:
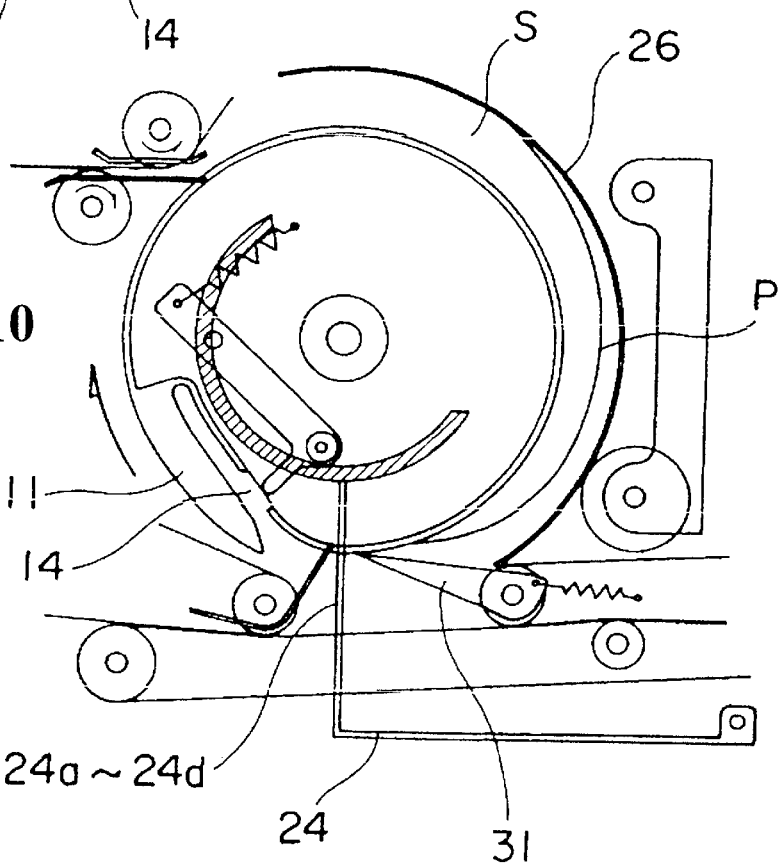
FIG. 10 is a side sectional view showing bills accumulated in a reserving space.

FIG. 10 is a side sectional view showing the bills accumulated in the reserving space. In this figure, as the accumulating wheel 11 further continues to rotate, the bill P, the tip of which is bound by the regulating sections 24*a* to 24*d*, exits the inside of the groove 14. At this point, the tip of the gate 31 presses the bill P gently from below. As the wheel further rotates, the radius of the outer circumferential surface of the accumulating wheel 11 constituting the reserving space S gradually increases, so that at the positions of the regulating sections 24*a* to 24*d* of the stopper 24, the tip of the bill, which has left the groove 14, is moved downward by the outer circumferential surface of the accumulating wheel 11. Inside the reserving space S, the bill P is pressed toward the guide plate 26.

Figure 11:
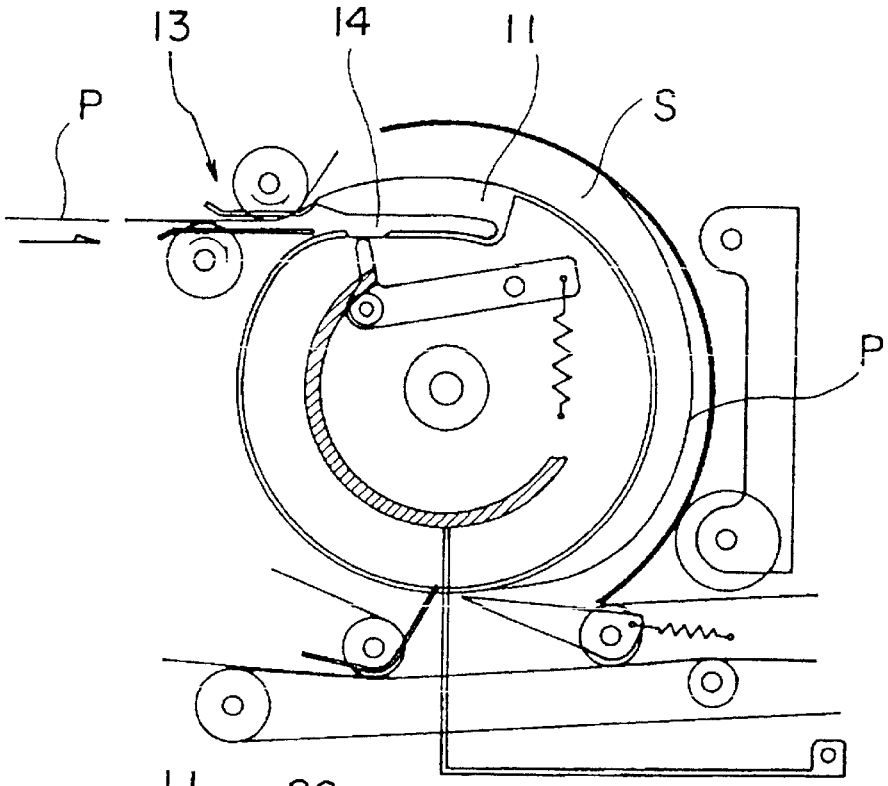
FIG. 11 is a side sectional view showing the accumulating wheel returning to its accumulation standby state.

FIG. 11 is a side sectional view showing the accumulating wheel returned to its accumulation standby state. In this figure, the accumulating wheel 11 is stopped with the bill P reserved in the reserving space S and the groove 14 open toward the bill input section 13, in order to wait for a next bill to accumulate. By repeating the operations from FIGS.

5 to 11, multiple bills can be accumulated and reserved in the reserving space S. In this case, since a part of the accumulating wheel 11 including the groove 14, which has the largest radius, leads the reserving space S in the rotation of the accumulating wheel 11, the outer circumferential surface of the part pushes the accumulated bills P toward the guide plate 26. Thus, the bill P is transferred while the accumulation space is being maintained in the reserving space S. Consequently, while the bill is being transferred through the reserving space S, the friction between the transferred bill and other accumulated bills is reduced to prevent the bill from slipping out of the clamper 15 during transfer.

The operation for transferring the accumulated and reserved bills is described with reference to FIGS. 12 to 14.

Figure 12:
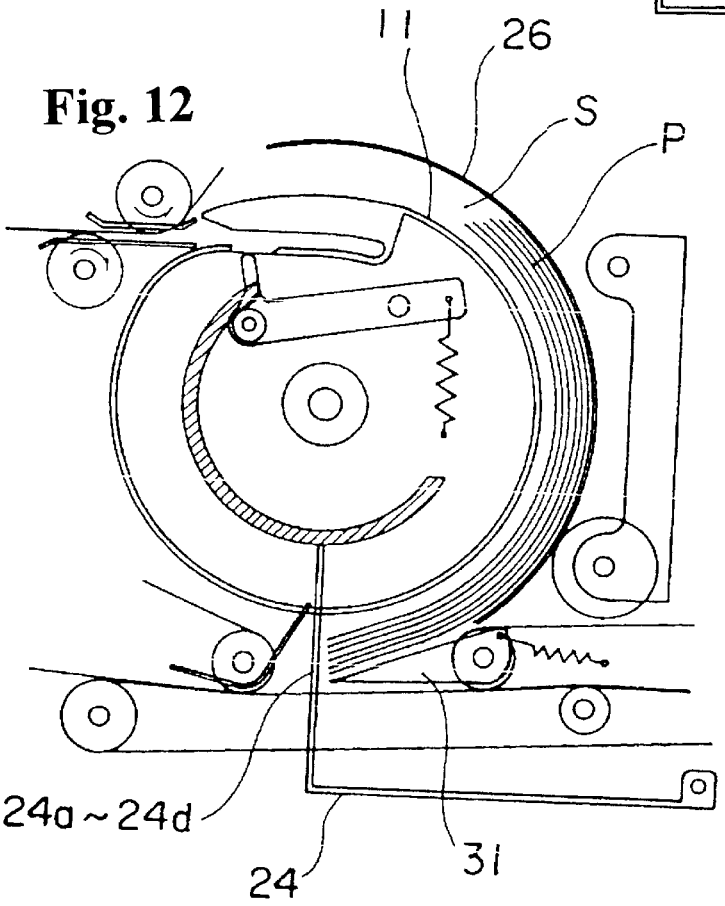
FIG. 12 is a side sectional view showing multiple bills accumulated in the reserving space.

FIG. 12 is a side sectional view showing multiple bills accumulated in the reserving space. In this figure, the accumulation of the bills has been completed and the accumulating wheel 11 has been rotated up to its accumulation standby position, so that the multiple bills P are reserved in the reserving space S formed by the outer circumferential surface of the accumulating wheel 11 and the guide plate 26. At this point, the multiple bills P are aligned in such a way that their tips abut against the regulating sections 24*a* to 24*d* of the stopper 24. In addition, the tip of the gate 31 is somewhat pushed downward due to the rigidity of the accumulated bills P.

Figure 13:
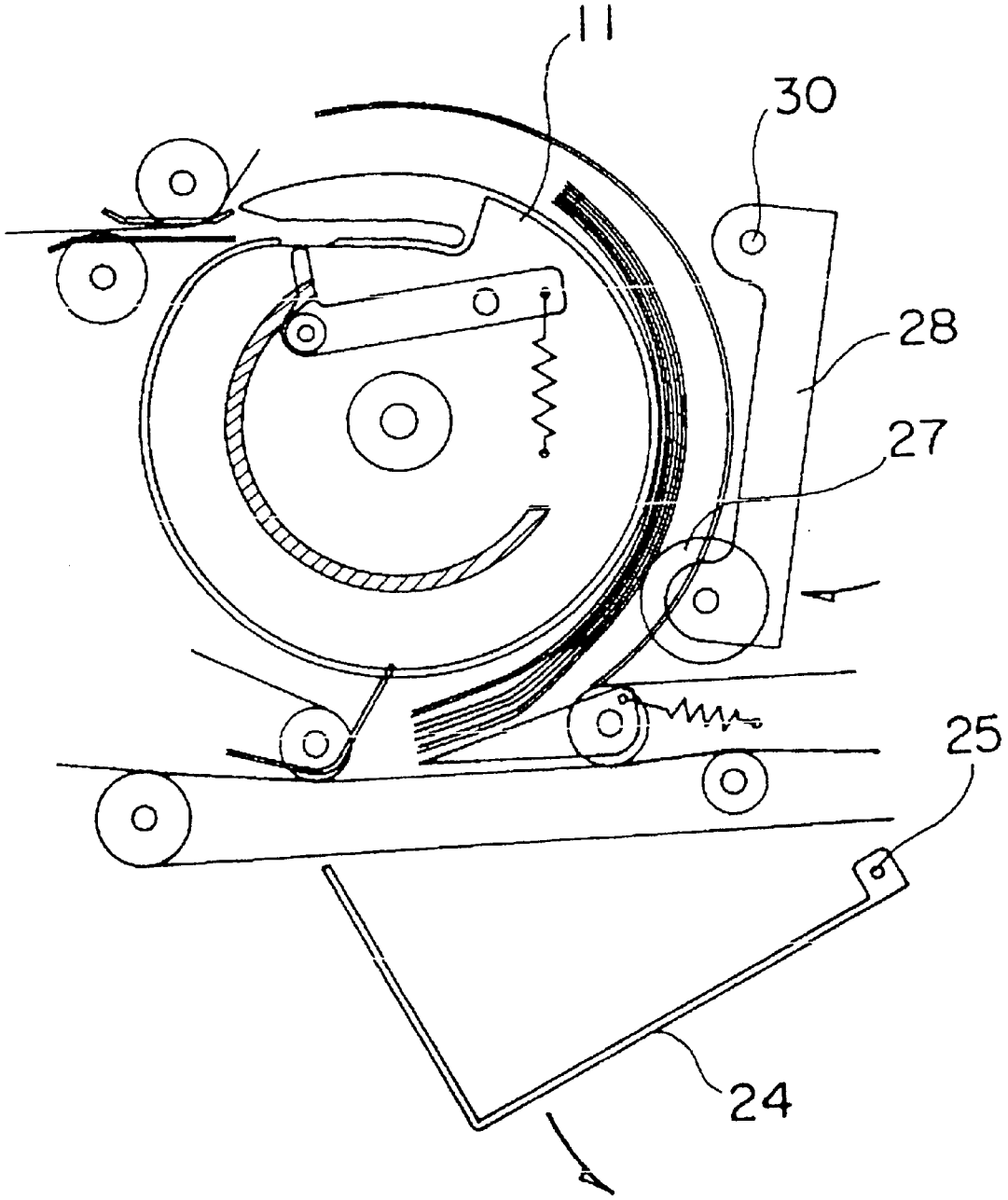
FIG. 13 is a side sectional view showing the state immediately before reserved bills are transferred.

FIG. 13 is a side sectional view showing the state immediately before the reserved bills are transferred. In this figure, when an instruction to receive or return the reserved bills is received, the stopper 24 is rotationally driven in the counterclockwise direction around the supporting shaft 25 by the actuator (not shown) to release the restriction of the bills P in the transfer direction. The supporting plate 28 provided behind the guide plate 26 is also driven in the clockwise direction around the supporting shaft 30 by the actuator (not shown). Thus, the presser roller 27 supported by the supporting plate 28 presses the bills P accumulated in the reserving space S to sandwich them between the presser roller 27 and the accumulating wheel 11.

Figure 14:
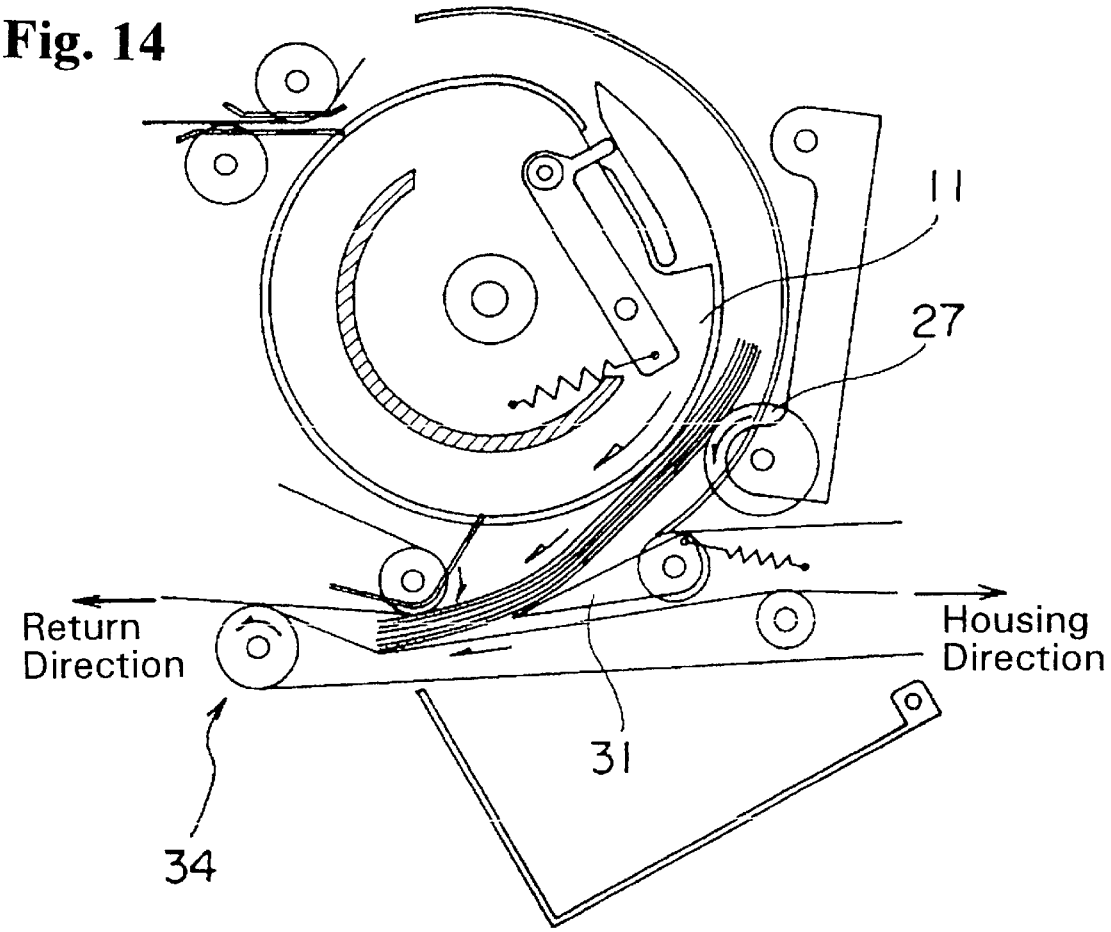
FIG. 14 is a side sectional view showing the reserved bills being transferred.

FIG. 14 is a side sectional view showing the reserved bills being transferred. To transfer the bills P, the receive/return transfer section 34 is first driven to transfer the bills in the return direction, and the accumulating wheel 11 is then rotated in the clockwise direction. Since the presser roller 27 rotates while pressing the bills P against the outer circumferential surface of the accumulating wheel 11, the friction between the outer circumferential surface of the accumulating wheel 11 and the bills P forces the bills P to be transferred toward the receive/return transfer section 34 as the accumulating wheel 11 rotates. Once the rear ends of the bills P moved out from the reserving space S have passed through the gate 31, the receive/return transfer section 34 performs a transfer operation according to the instruction for the accumulated bills P. That is, if the instruction indicates reception, the receive/return transfer section 34 reverses its drive direction to transfer the bills P in the housing direction, that is, toward the bill housing 7. In addition, if the instruction indicates return, the receive/return transfer section 34 maintains the same drive direction to transfer the bills P in the return direction, that is, toward the input and return section 2.

Next, a second embodiment of a temporary reserving section is described.

Figure 15:
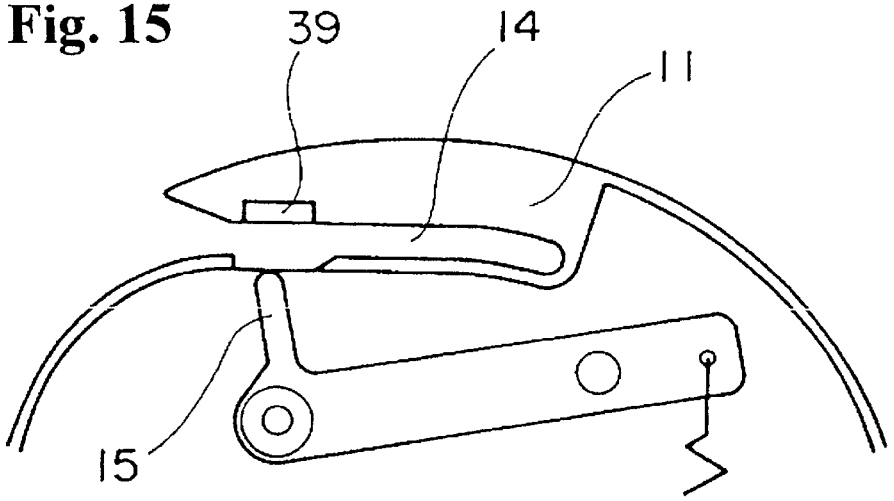
FIG. 15 is a schematic enlarged side sectional view of the temporary reserving section according to a second embodiment.

FIG. 15 is a schematic enlarged side sectional view of the temporary reserving section according to the second embodiment. In this figure, the same components as in the first embodiment shown in FIG. 1 have the same reference numerals and their detailed description is omitted, except for unique features.

A friction member 39 formed of a material with a large friction coefficient, e.g. rubber, is buried in a part of the inner wall of the groove 14 in the accumulating wheel 11 opposed to the clamper 15. Thus, when the clamper 15 grips the bill P carried into the groove 14, the friction member 39 serves to improve the gripping force of the clamper 15 to stabilize the accumulating operation. When the bills P are accumulated in the reserving space S and the tip of a transferred bill P is clamped and drawn into the reserving space S, a large amount of resistance occurs between the accumulated bills P and the transferred bill P. Thus, the friction member 39 can be provided opposite to the clamper 15 to provide sufficient force to overcome the resistance.

Although in the example shown in FIG. 15, the friction member 39 is provided on the inner wall of the groove 14, it may be provided at the tip of the clamper 15 entering the groove 14, or in both the inner wall of the groove 14 and the tip of the clamper 15.

Next, a third embodiment of a temporary reserving section is described.

Figure 16:
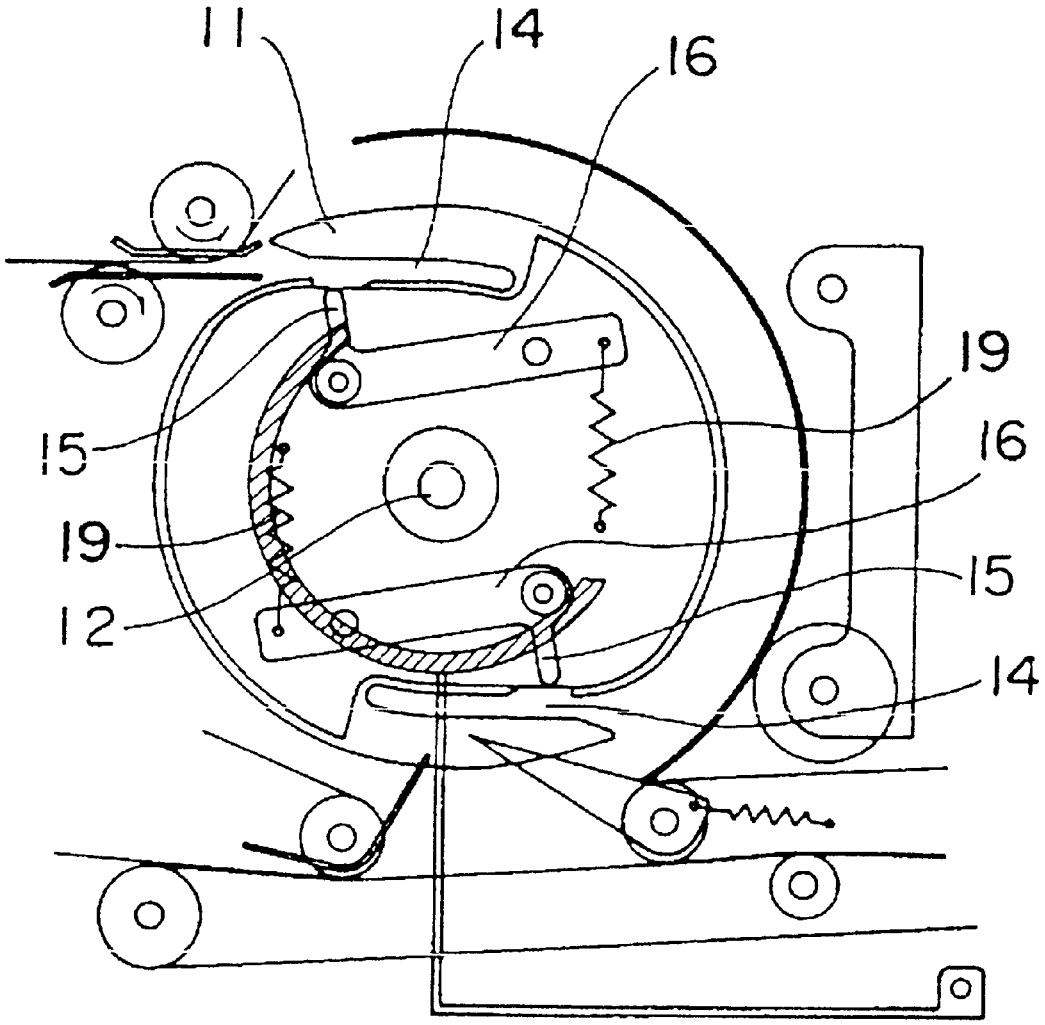
FIG. 16 is a side sectional view of a temporary reserving section according to a third embodiment.

FIG. 16 is a side sectional view of the temporary reserving section according to the third embodiment. In this figure, the same components as in the first embodiment shown in FIG. 1 have the same reference numerals and their detailed description is omitted, except for unique features.

In FIG. 16, two sets of the groove 14 and a bill-clamping mechanism are provided in the single accumulating wheel 11. That is, two grooves 14 on the outer circumferential surfaces of the accumulating wheel 11, two dampers 15, two arms 16, each having a roller 21, and two tension springs 19 are located symmetrically relative to the rotational center of the accumulating wheel. The accumulating wheel 11 has a circumferential length at least twice of the length of the longest bill. This reduces the rotational angle of the accumulating wheel 11 required to accumulate a single bill P to half in the first embodiment. Thus, the bill accumulation speed can be increased.

Although the two sets of the groove and clamp mechanism are shown in FIG. 16, the size of the accumulating wheel may be increased to allow more than two sets of the groove and clamp mechanism to be provided therein, in order to further increase the speed of the bill accumulation processing.

Next, a fourth embodiment of a temporary reserving section is described.

FIG. 17 is a partially cut perspective view of the temporary reserving section according to the fourth embodiment. In this figure, the same components as in the first embodiment shown in FIG. 1 have the same reference numerals and their detailed description is omitted, except for unique features.

In the temporary reserving section shown in FIG. 17, the connection shaft 20 penetrating through the holes formed by drilling the accumulating wheels 11*a* to 11*c* is fixed to the arms 16*a* and 16*c* of the accumulating wheels 11*a* and 11*c* located on the respective sides, but not to the arm 16*b* of the accumulating wheel 11*b* located in the middle. That is, a hole 40 having a larger diameter than the connection shaft 20 is drilled at a position of the arm 16*b* through which the connection shaft 20 passes, so that the connection shaft 20 is loosely inserted into the hole 40. This structure causes the movement of the connection shaft 20 to be transmitted to the middle arm 16*b* via the large hole 40, thereby allowing the clamper 15*b* to operate differently from the dampers 15*a* and 15*c* of the arms 16*a* and 16*c* on the respective sides.

Next, the bill accumulating and reserving operation of the temporary reserving section is described. Since the basic operation of this section is the same as that of the temporary reserving section according to the first embodiment, only the unique features are described below.

FIG. 18 is a side view showing the bill accumulation standby state of the accumulation wheel located in the middle. When the temporary reserving section is in the bill accumulation standby state, the accumulating wheel lib is stopped in the illustrated rotational position with the groove 14*b* open to receive a bill transferred from the bill input section 13 in a straight manner. In addition, the rollers 21 provided on the respective sides of the connection shaft 20 are positioned on the cams 23 to hold the arm 16*b* in the counterclockwise direction around the supporting shaft 17 against the tensile force of the tension spring 19*b*, thereby holding the clamper 15*b* out from the inside of the groove 14*b*. Since, however, the diameter of the hole 40 drilled in the arm 16*b* is larger than that of the connection shaft 20, the clamper 15*b* is stopped closer to the groove 14*b* than the dampers 15*a* and 15*c* by half the distance corresponding to this difference in diameter.

Figure 19:
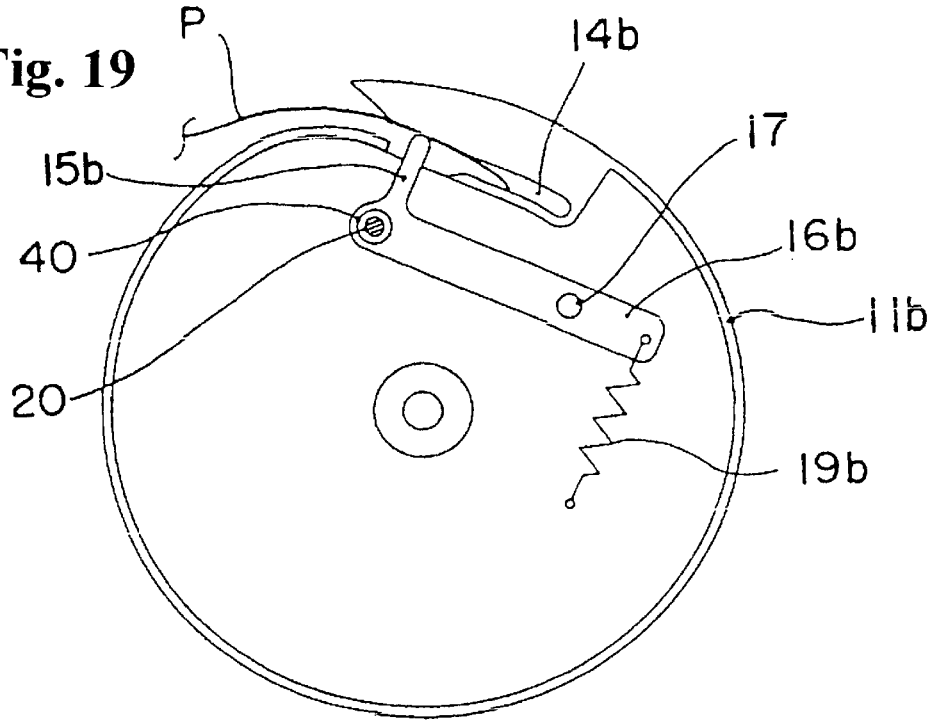
FIG. 19 is a side view showing the bill clamping state of the accumulating wheel located in the middle of the temporary reserving section of the fourth embodiment.

FIG. 19 is a side view showing the bill-clamping state of the accumulating wheel located in the middle. The bill P is carried into the groove 14*b* in the accumulating wheel 11*b* by the bill input section 13, and after a predetermined time, the motor (not shown) begins to rotate the accumulating wheel 11*b* clockwise as shown in the figure. The rollers 21 provided on the respective sides of the connection shaft 20 then leave the cams 23 to cause the arm 16*b* to be rotated clockwise around the supporting shaft 17 due to the urging force of the tension spring 19*b*, thereby causing the damper 15*b* to move into the groove 14*b*. Thus, the bill P sitting in the groove 14*b* is gripped by the upper inner wall of the groove 14*b* and the clamper 15*b*, and transferred integrally with the rotating accumulating wheel 11*b*. At this point, since the arm 16*b* does not contact the connection shaft 20, the clamper 15*b* provides an independent bill-holding force not restrained by the other dampers 15*b* and 15*c*. This allows the bill P to be further reliably clamped to prevent the bill P from slipping out from the clamper 15 during the accumulating and reserving operation to cause a jam.

Next, a fifth embodiment of the temporary reserving section is described.

Figure 20:
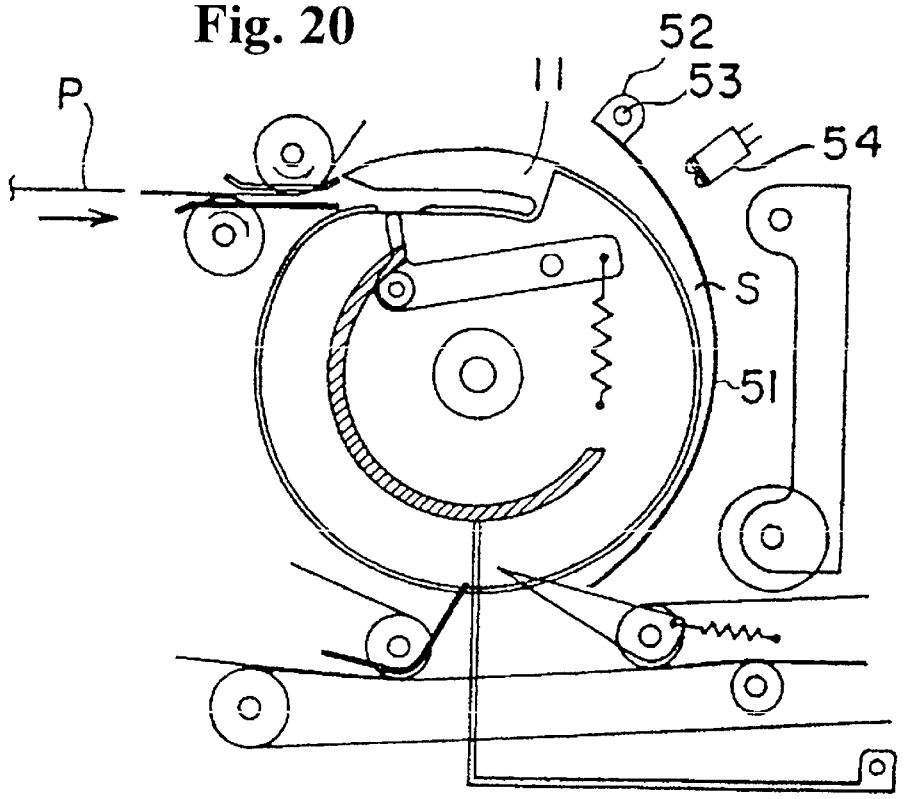
FIG. 20 is a side sectional view of the temporary reserving section according to a fifth embodiment.

FIG. 20 is a side sectional view of the temporary reserving section according to the fifth embodiment. In this figure, the same components as in the first embodiment shown in FIG. 1 have the same reference numerals and their detailed description is omitted, except for unique features.

In the temporary reserving section shown in FIG. 20, a movable guide plate 51 is provided to the right side of the accumulating wheel 11 at a predetermined interval from the outer circumferential surface thereof. The movable guide plate 51 has a circular arc shape with a diameter larger than the outer circumferential circle of the accumulating wheel 11, and bearing pieces 52 at the respective ends at the upper edge. A shaft 53, both ends of which are fixed to the side plates 22*a* and 22*b*, passes through the bearing pieces 52, and the movable guide plate 51 is suspended from the shaft 53 in such a way as to oscillate or swing around it. Thus, the movable guide plate 51, the outer circumferential surface of the accumulating wheel 11, the side plates 22*a* and 22*b*, and the regulating sections 24*a* to 24*d* of the stopper 24 form a bill reserving space S, in which the thickness of the accumulated bills varies according to the number of the bills.

A movable-guide-plate position sensor 54 is provided behind the movable guide plate 51 at a predetermined interval from its rear surface. The movable-guide-plate position sensor 54 is preferably a reflecting photo sensor that responds to the movable guide plate 51 when it approaches within a certain distance from the sensor, but may be another non-contact sensor such as a proximity sensor that uses magnetic characteristics or a photo interrupter. The output of the movable-guide-plate position sensor 54 is connected to a control circuit (not shown) for controlling the operation of the temporary reserving section.

Figure 21:
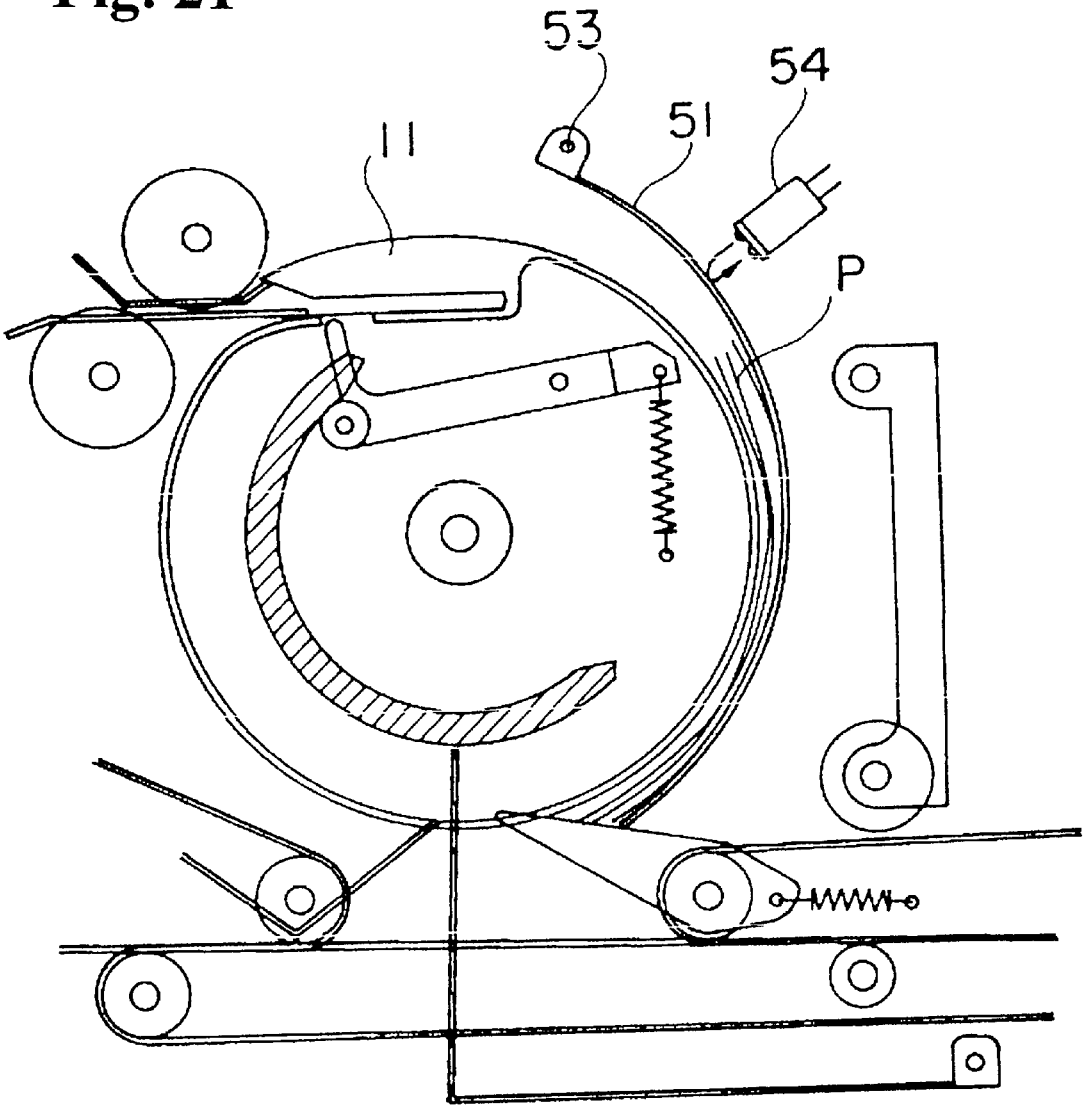
FIG. 21 is a side sectional view of the temporary reserving section according to the fifth embodiment in the bill accumulation state.

FIG. 21 is a side sectional view of the temporary reserving section according to the fifth embodiment showing a bill accumulation state. When no bills are accumulated in the reserving space S, the movable guide plate 51 hangs from the shaft 53 due to its own weight and is closest to the outer circumferential surface of the accumulating wheel 11. When a bill is then drawn into the reserving space S, it is accumulated after passing through the narrow gap formed by the accumulating wheel 11 and movable guide plate 51, regardless of its condition, that is, whether it is wrinkled, folded, or curled. This configuration prevents, for example, a curled bill from being accumulated as it is.

The bills P are accumulated in the reserving space, and when the thickness of the bills P accumulated in the reserving space S becomes greater than the gap between the accumulating wheel 11 and the movable guide plate 51 that exists when no bills are accumulated, the bills P tend to push the movable guide plate 51 outwardly. The bills P are then subjected to an appropriate pressure in the thickness direction from the movable guide plate 51, resulting in a stable accumulation condition.

When the accumulation continues to increase the number of accumulated bills, the movable guide plate 51 correspondingly rotates around the shaft 53 in the direction of leaving the accumulating wheel 11. Since the rotational position of the movable guide plate 51 varies with the thickness of the accumulated bills, the thickness can be estimated from the rotational position, which is detected by the movable-guide-plate position sensor 54. Thus, when the movable-guide-plate position sensor 54, which monitors the thickness of the accumulated bills, detects a predetermined thickness of the accumulated bills, it notifies the control circuit (not shown) of the detection. Determining that the thickness of the accumulated bills has reached a maximum value at which the bills can be transported in the downstream of the temporary reserving section, the control circuit instructs to stop the accumulating operation and to execute the next process. This operation can prevent troubles during the transportation of the accumulated bills.

Next, a sixth embodiment of a temporary reserving section in which the movable guide plate 51 is forced toward the accumulating wheel 11 is described.

Figure 22:
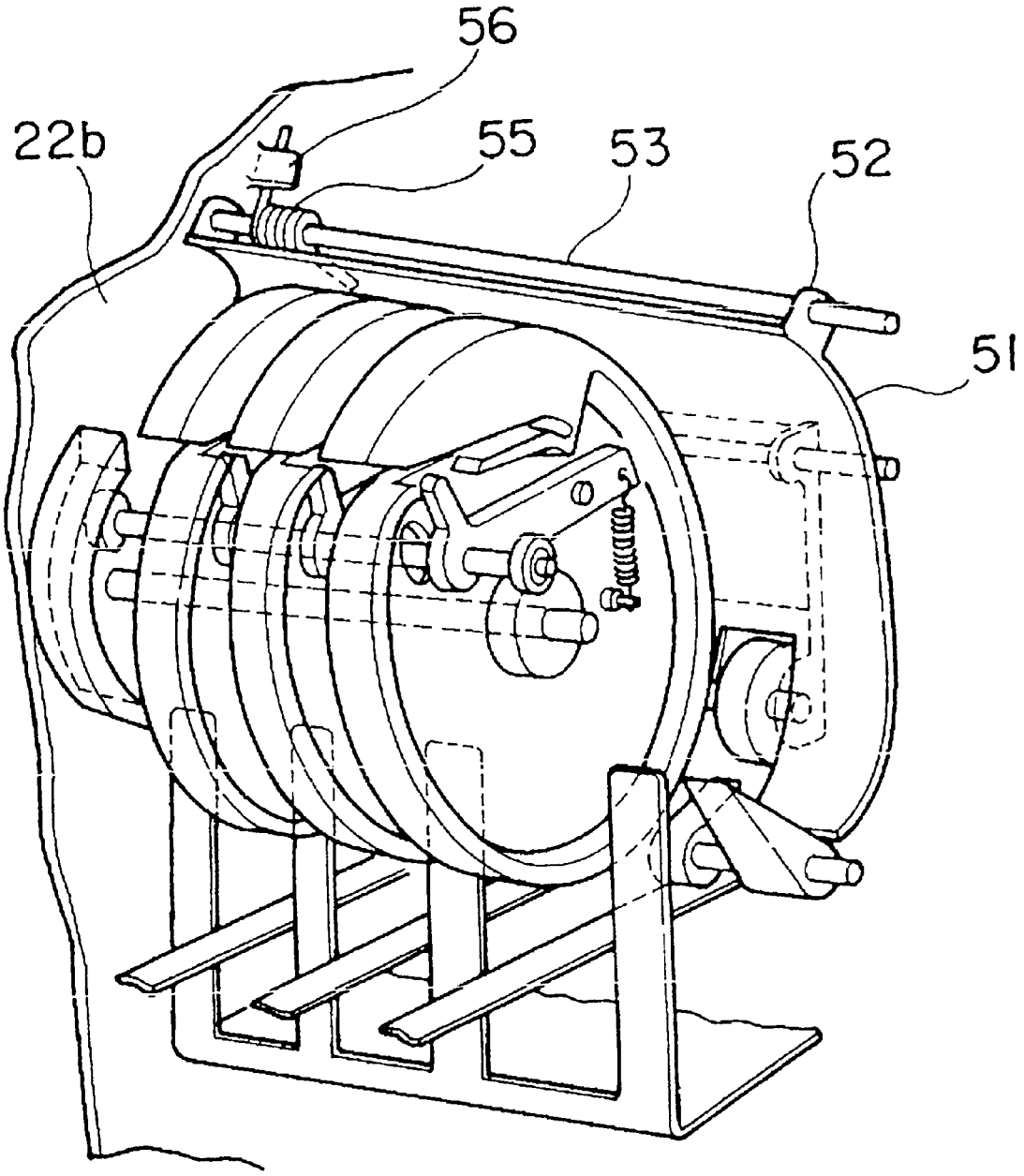
FIG. 22 is a partially cut perspective view of the temporary reserving section according to a sixth embodiment.

FIG. 22 is a partially cut perspective view of the temporary reserving section according to the sixth embodiment. On the whole, the configuration shown in FIG. 22 is virtually the same as that of the first embodiment shown in FIG. 3, so that a detailed description of each component is omitted, except for unique features.

In the temporary reserving section shown in FIG. 22, the movable guide plate 51 provided to the right side of the accumulating wheel 11 at a predetermined interval from the outer circumferential surface thereof has a circular arc shape with a diameter larger than the outer circumferential circle of the accumulating wheel 11. The movable guide plate 51 has, at the respective ends of its upper edge, bearing pieces 52 for allowing the shaft 53 to pass therethrough, with both ends of the shaft being fixed to the side plates 22*a* and 22*b*, respectively. A torsion coil spring 55 is installed on the shaft 53. One end of the torsion coil spring 55 is engaged with a stopper 56 provided on the side plate 22*b*, while the other end is engaged with the movable guide plate 51 in order to constantly urge the movable guide plate 51 toward the accumulating wheel 11.

In the bill reserving space S formed by the movable guide plate 51, the outer circumferential surface of the accumulating wheel 11, the side plates 22*a* and 22*b*, and the regulating sections 24*a* to 24*d* of the stopper 24, due to the urging force of the torsion coil spring 55, the size of the gap in the thickness direction of the bills is always maintained at its minimum value. Thus, in the reserving space S, the accumulated bills are constantly urged toward the outer circumferential surface of the accumulating wheel 11 by the movable guide plate 51. As a result, during introduction of the bill into the reserving space S, a curled bill is prevented from being accumulated on previously accumulated bills as it is, thereby enabling the bills to be accumulated and reserved so as to be aligned along the outer circumferential surface of the accumulating wheel 11.

Finally, a seventh embodiment of a temporary reserving section in which the sensor for monitoring the thickness of accumulated bills is provided at a different position is described.

Figure 23:
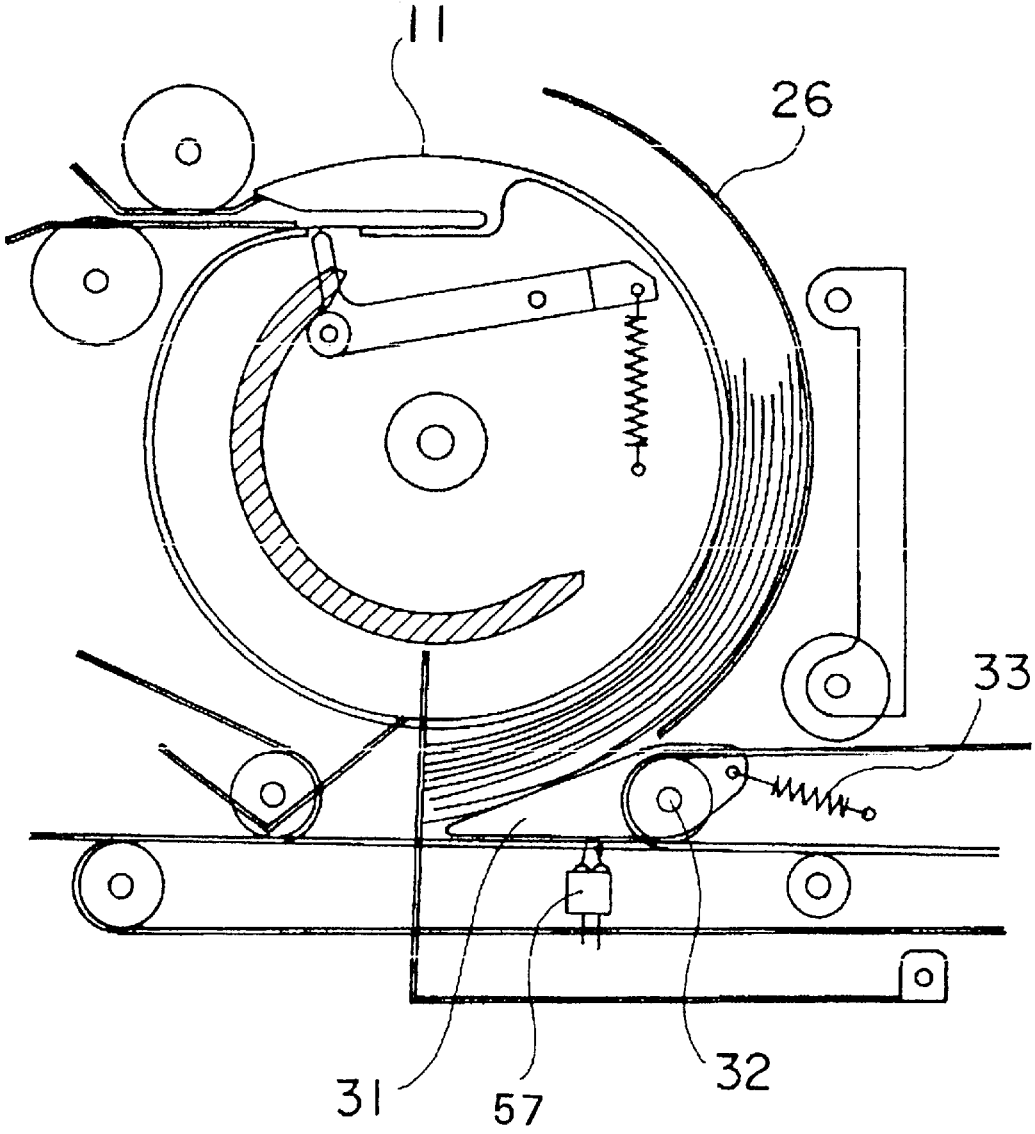
FIG. 23 is a side sectional view of the temporary reserving section according to a seventh embodiment.
Figure 24:
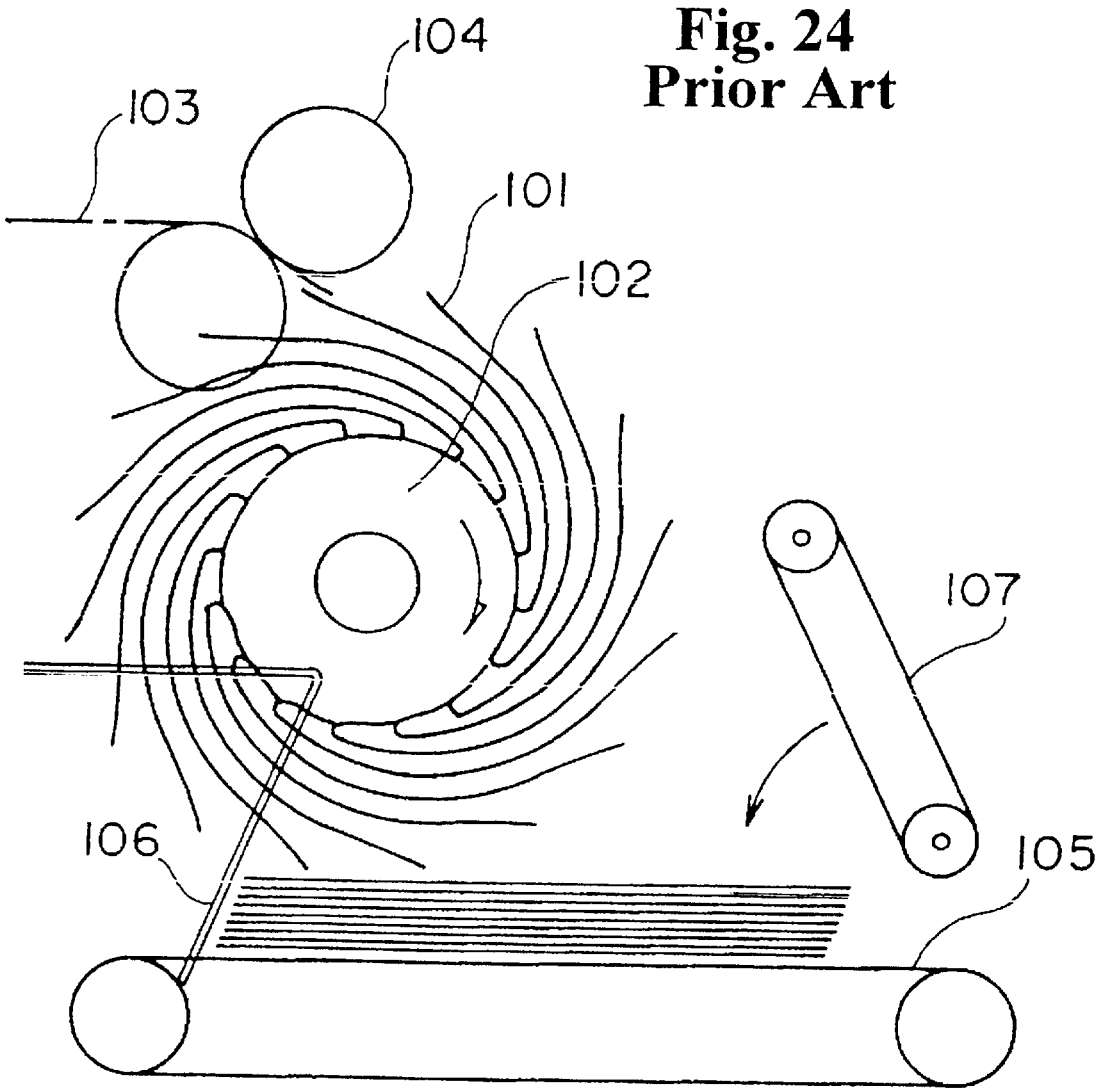
Fig. 24 Prior Art
FIG. 24 is a schematic explanatory drawing showing an example of a conventional temporary storage device.
Figure 25:
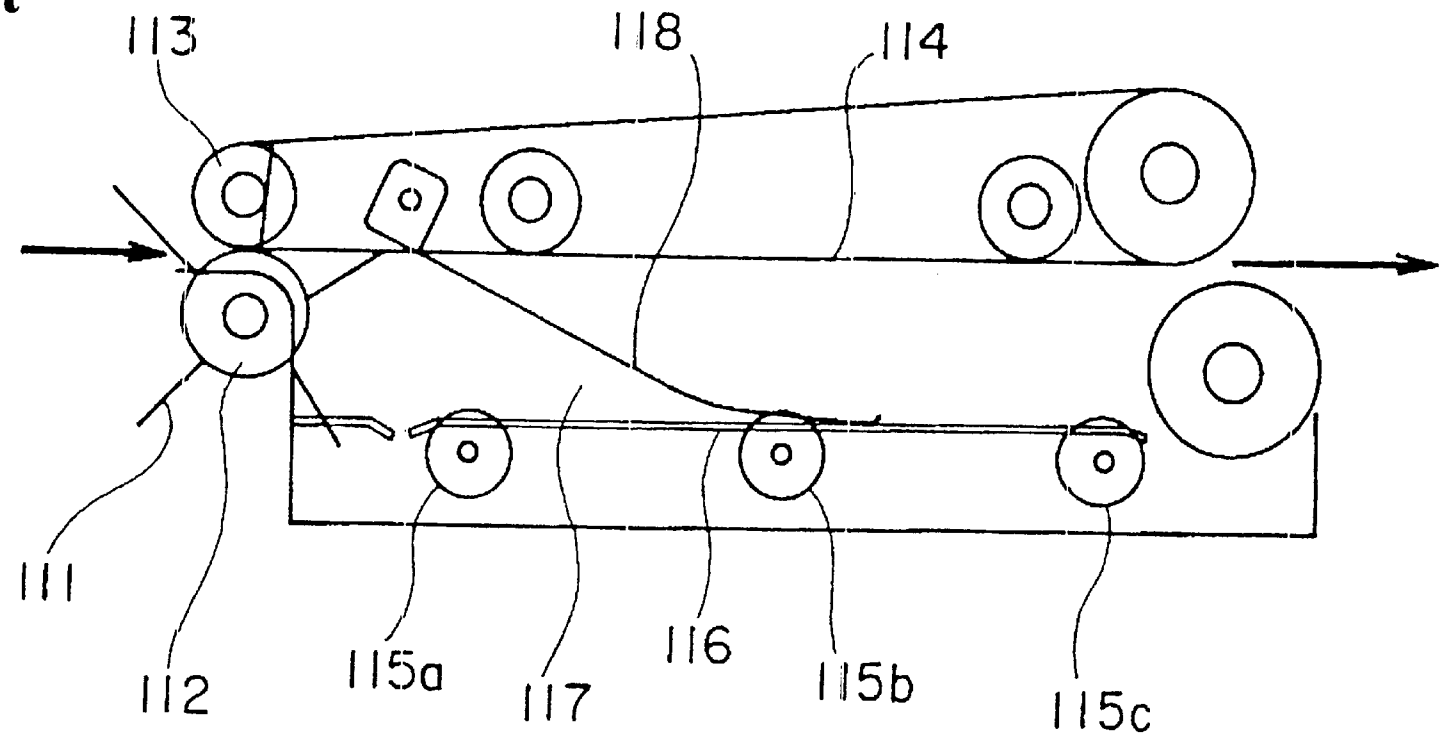
Fig. 25 Prior Art
FIG. 25 is a schematic explanatory drawing showing another example of a conventional temporary storage device.
Figure 26B:
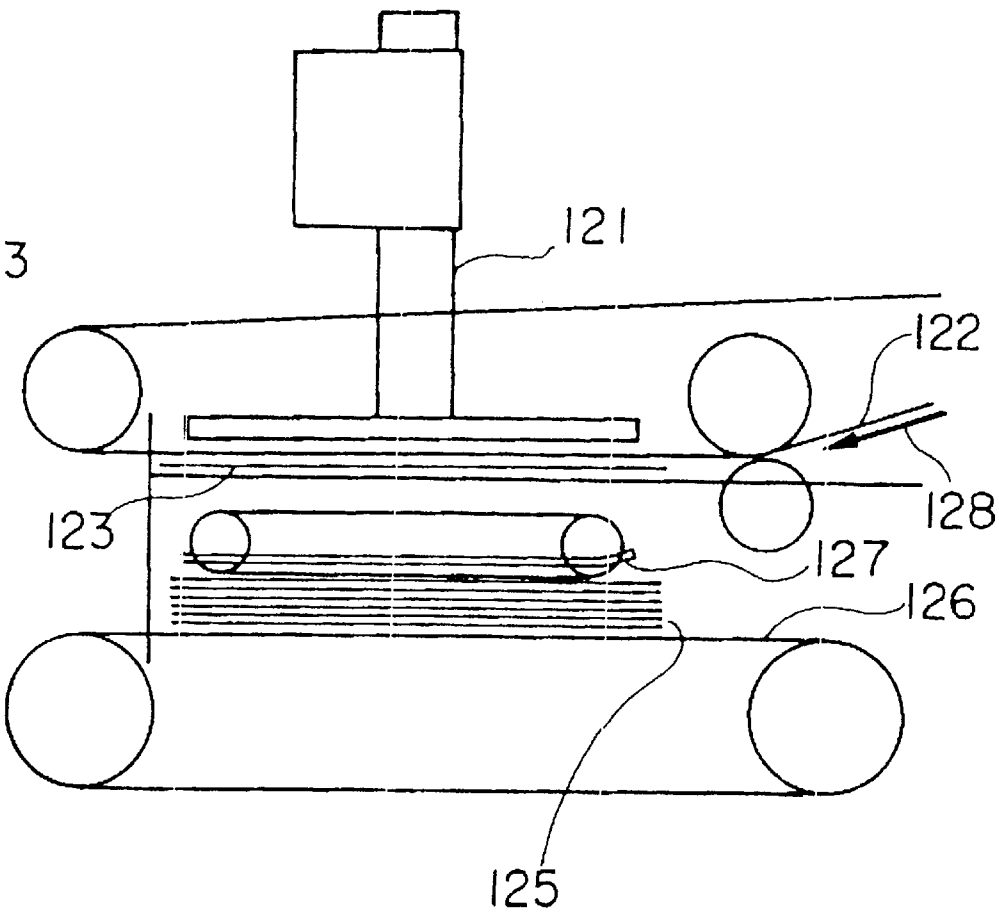
Fig. 26(B) Prior Art
Figure 26A:
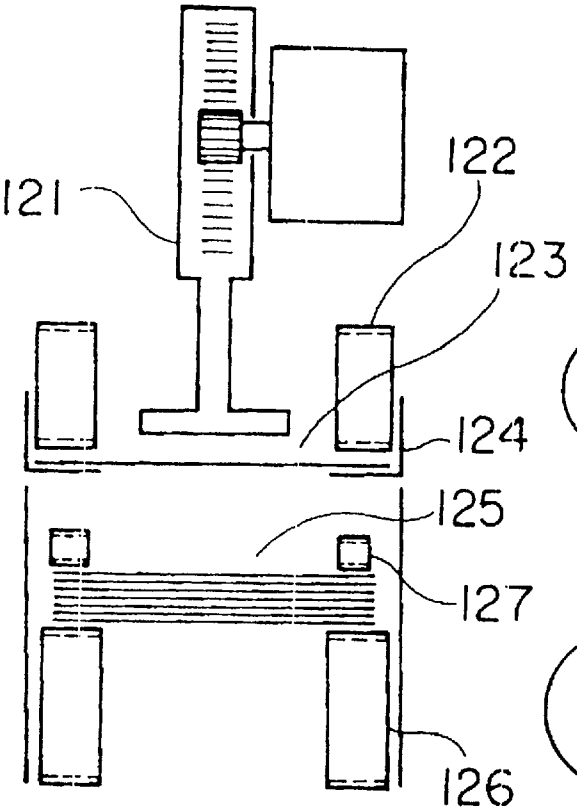
Fig. 26(A) Prior Art

FIG. 23 is a side sectional view of the temporary reserving section according to the seventh embodiment. Although the configuration shown in FIG. 23 has a fixed reserving space S, it may have a movable guide plate and a variable reserving space S that varies in the thickness direction according to the thickness of the accumulated bills. Only the unique features of this embodiment are described below.

In the temporary reserving section shown in FIG. 23, a gate 31 supported by the shaft 32 in such a way as to oscillate and urged clockwise by the tension spring 33 is provided near the lower end of the guide plate 26, and a gate-position detection sensor 57 is located under the gate 31 for detecting the movement of the gate. The gate-position detection sensor 57 is connected to the control circuit (not shown).

The tip of the gate 31 is located inside the outer circumference of the accumulating wheel 11 if no bills are accumulated in the reserving space S, whereas it presses accumulated bills gently against the outer circumferential surface of the accumulating wheel 11 if any bills are accumulated thereon. As the thickness of the accumulated bills increases, the gate 31 is rotated in the direction of leaving the accumulating wheel 11. Since the distance between the tip of the gate 31 and the outer circumferential surface of the accumulating wheel 11 is almost equal to the thickness of the accumulated bills during the returning or housing operation, the thickness of the accumulated bills can be estimated by detecting the position of the gate 31, which is detected by the gate-position detection sensor 57 used as a thickness detection arm.

When the thickness of the accumulated bills reaches a predetermined value, that is, the maximum value at which the bills 25 can be transferred, the gate-position detection sensor 57 detects the thickness and communicates with the control circuit (not shown). Upon receiving this information from the gate-position detection sensor 57, the control circuit instructs to stop the accumulating operation in the temporary reserving space and to execute the next process. As stated above, the gate-position detection sensor 57 monitors the thickness of the accumulated bills and the accumulating operation is stopped when the thickness reaches the maximum value within which the bills can be transferred, thereby preventing troubles during the transfer of the accumulated bills.

As described above, this invention includes an accumulating wheel having a clamper that grips a medium introduced into the groove, so that the clamper grips and draws the medium into the reserving space for accumulation. This configuration allows the medium sitting in the groove in the accumulating wheel to be reliably held and transferred by the clamper in order to prevent the transferred medium from slipping out of the accumulating wheel. In addition, since the tip of the medium being transferred is disposed in the groove, it does not collide with accumulated medium or bills. Thus, worn-out bills and bills that are susceptible to buckling or bending can be reliably accumulated.

In addition, the rotational movement of the accumulating wheel is used to allow the clamper to protrude into and retract from the groove, enabling the processing speed to be increased. A plurality of grooves and clamp mechanisms can be provided on the accumulating wheel to further increase the processing speed.

Furthermore, a plurality of accumulating wheels can be provided to enable the medium to be clamped at a plurality of positions, thereby enabling even media such as foreign bills that are nearly twice as large as Japanese ones to be reliably drawn into the reserving space for accumulation. Furthermore, at least one of the dampers of the accumulating wheels is formed so that it can grip a medium without being restrained by the other clampers. Thus, the force acting to clamp the medium is increased, enabling a more stable accumulating operation. Since this clamper operates independently of the other clampers, it is possible to absorb the difference of the media-holding force caused by differences between this clamper and other dampers in terms of the size of the accumulating wheel, the size of the clamper itself, or the assembly accuracy, thereby providing an inexpensive temporary reserving section.

In addition, the guide plate constituting the reserving space is movable, so that it can press the media accumulated in the reserving space toward the accumulating wheel by using its own weight or the force of the spring in order to eliminate an idle space from the reserving space. Thus, even significantly curled medium or one that are susceptible to buckling or bending is constantly subjected to pressure, so that the medium can be accumulated so as to be aligned along the outer circumferential surface of the accumulating wheel.

Since the sensor for monitoring the thickness of the accumulated bills is provided to stop the accumulating operation when a predetermined thickness is detected, the thickness of the accumulated bills can be constantly maintained at or below the maximum value within which the bills can be transported in the downstream of the temporary reserving section. Therefore, when this invention is applied to a bill input machine, troubles are prevented when reserved bills are returned or housed in the housing in a batch.

What is claimed is:

1. A medium-reserving apparatus for receiving and reserving at least one individually transferred medium and discharging reserved media in a batch, comprising:

an accumulating wheel having an outer surface, and a groove portion opened in the outer surface adapted to receive a tip of a medium for holding, said accumulating wheel being rotated from a medium standby position to a medium release position;

a clamper formed in the accumulating wheel adapted to clamp the tip of the medium introduced into the groove portion and to release the medium at the medium release position; and a medium-accumulating section formed outside the accumulating wheel for accumulating the medium released at the medium-release position, said medium-accumulating section having a movable guide plate with a circular arc cross section located outside the outer surface of the accumulating wheel to constitute a variable medium-accumulating space between the guide plate and the accumulating wheel, which is changed depending on the thickness of accumulated media.

2. A medium-reserving apparatus according to claim 1, further comprising a sensor formed near the accumulating wheel adapted to detect introduction of the tip of the medium into the groove portion, and a drive section connected to the accumulating wheel, said drive section driving said accumulating wheel in the medium standby position to a next medium standby position in response to the sensor detecting the introduction of the tip of the medium into the groove portion.

3. A medium-reserving apparatus according to claim 2, wherein said drive section rotates the accumulating wheel to the medium release position at an outer circumferential speed at most equal to a speed that the medium is supplied into an input position.

4. A medium-reserving apparatus according to claim 1, wherein said clamper has a medium press member installed in the accumulating wheel, said medium press member entering into the groove portion to clamp the tip of the medium introduced into the groove portion in cooperating with an inner wall of the groove portion and leaving the groove portion to release clamping of the tip of the medium.

5. A medium-reserving apparatus according to claim 4, further comprising a housing with side plates for rotatably holding the accumulating wheel, said clamper further including a cam section fixed to at least one of the side plates and having a circular guide surface concentric with a rotational center of the accumulating wheel, said cam section allowing the medium press member to move along the guide surface to have the medium press member to leave the groove portion when the accumulating wheel is rotationally moved from the medium release position to the medium standby position; and a spring section for urging the medium press member in the direction to enter the groove portion during a period immediately after the accumulating wheel leaves the medium standby position to the medium release position.

6. A medium-reserving apparatus according to claim 4, wherein said clamper further includes a friction member provided on at least one of the medium press member and the inner wall of the groove portion opposite the medium press member.

7. A medium-reserving apparatus according to claim 1, wherein said movable guide plate has an axis and an upper edge swingably journaled to the axis, said movable guide plate suspending from the axis by a weight thereof to press the media accumulated on the outer surface of the accumulating wheel toward the accumulating wheel.

8. A medium-reserving apparatus according to claim 1, wherein said movable guide plate has an axis, an upper edge swingably journaled to the axis, and a spring to urge the guide plate toward the outer surface of the accumulating wheel.

9. A medium-reserving apparatus according to claim 1, further comprising thickness detection means situated near the movable guide plate, said thickness detection means detecting a position of the movable guide plate to detect the thickness of a batch of the media accumulated in the variable medium-accumulating space.

10. A medium-reserving apparatus according to claim 9, wherein said thickness detection means has a function such that a medium-accumulating operation is stopped when the thickness of the batch of the media reaches a predetermined value.

11. A medium-reserving apparatus according to claim 1, wherein said accumulating wheel has an outer circumferential length at least equal to a length of the medium in a transfer direction.

12. A medium-reserving apparatus according to claim 1, wherein said accumulating wheel with the outer surface has a radius gradually decreasing in a rotational direction of the accumulating wheel, said groove portion being provided in a stage portion where portions of the outer surface with different radii merge.

13. A medium-reserving apparatus according to claim 1, wherein said groove portion extends parallel to a tangential direction of the outer surface of the accumulating wheel, an extending direction of the groove portion being substantially identical to a medium introduction direction.

14. A medium-reserving apparatus according to claim 1, wherein said accumulating wheel includes a plurality of sub-accumulating wheels, and said clamper includes a plurality of sub-clamper sections formed on the sub-accumulating wheels and oriented perpendicular to a medium transfer direction.

15. A medium-reserving apparatus according to claim 1, wherein said accumulating wheel includes a plurality of the groove portions opened in the outer surface of the accumulating wheel to introduce the tip of the medium, each groove portion having the clamper section.

16. A bill input apparatus comprising:

a money input section to which at least one bill is inputted, a bill separating section connected to the money input section for sequentially delivering bills, a bill discriminating section connected to the bill separating section, said bill discriminating section determining types of the delivered bills, counting a number of the bills of each money type, and discriminating genuine bills from counterfeit bills, a temporary reserving section connected to the bill discriminating section for aligning and accumulating at least one bill determined to be genuine by said bill discriminating section, said temporary reserving section including accumulating wheel means having a groove portion opened in an outer surface thereof corresponding to a position at which the bills are inputted from the bill discriminating section when the temporary reserving section is in a bill standby position, the groove portion introducing a tip of the inputted bill, said accumulating wheel means rotating from said bill standby position to a bill release position; a clamper section formed in the accumulating wheel means for clamping the tip of the bill introduced into the groove portion and releasing the bill at the bill release position; and bill accumulating means formed outside the accumulating wheel means for accumulating the bills released at the bill release position, a bill housing section connected to the temporary reserving section for housing in a batch the bills stored in the temporary reserving section, and a return section connected to the bill discriminating section for returning the bill determined to be counterfeit by said bill discriminating section and returning the bills stored in said temporary reserving section upon receipt of a return instruction.

17. A medium-reserving apparatus for receiving and reserving at least one individually transferred medium and discharging reserved media in a batch, comprising:

an accumulating wheel having an outer surface, and a groove portion opened in the outer surface adapted to receive a tip of a medium for holding, said accumulating wheel being rotated from a medium standby position to a medium release position;

a clamper formed in the accumulating wheel adapted to clamp the tip of the medium introduced into the groove portion and to release the medium at the medium release position;

a medium-accumulating section formed outside the accumulating wheel for accumulating the medium released at the medium-release position; and a transfer member situated outside the medium-accumulating section to be pressed toward the outer surface of the accumulating wheel, said transfer member cooperating with the outer surface of the accumulating wheel to transfer a batch of media accumulated on the medium-accumulating section.

18. A medium-reserving apparatus for receiving and reserving at least one individually transferred medium and discharging reserved media in a batch, comprising:

an accumulating wheel having an outer surface, and a groove portion opened in the outer surface adapted to receive a tip of a medium for holding, said accumulating wheel including a plurality of sub-accumulating wheels and being rotated from a medium standby position to a medium release position;

a clamper formed in the accumulating wheel adapted to clamp the tip of the medium introduced into the groove portion and to release the medium at the medium release position, said clamper including a plurality of sub-clamper sections formed on the sub-accumulating wheels and oriented perpendicular to a medium transfer direction, at least one of the sub-clamper sections formed on one of the sub-accumulating wheels being formed to independently hold the medium with respect to other sub-clamper sections; and a medium-accumulating section formed outside the accumulating wheel for accumulating the medium released at the medium-release position.

19. A medium-reserving apparatus according to claim 18, wherein said other sub-clamper sections are fixed by a connection shaft, and said at least one sub-clamper section holding the medium independently has a hole larger than a diameter of the connection shaft to allow the connection shaft to pass therethrough.

20. A medium-reserving apparatus according to claim 18, further comprising a regulation section having portions located on both sides of each sub-accumulating wheel on a downstream side of the outer surface of the accumulating wheel where the groove portion is located when the accumulating wheel is in the medium release position, said regulation section being disposed at a position crossing a surface of the groove section including a trace of a rotational movement of the groove section to remove from the groove portion the medium released at the medium release position.

21. A medium-reserving apparatus for receiving and reserving at least one individually transferred medium and discharging reserved media in a batch, comprising:

an accumulating wheel having an outer surface, and a groove portion opened in the outer surface adapted to receive a tip of a medium for holding, said accumulating wheel including a plurality of sub-accumulating wheels and being rotated from a medium standby position to a medium release position;

a clamper formed in the accumulating wheel adapted to clamp the tip of the medium introduced into the groove portion and to release the medium at the medium release position, said clamper including a plurality of sub-clamper sections formed on the sub-accumulating wheels and oriented perpendicular to a medium transfer direction;

a medium-accumulating section formed outside the accumulating wheel for accumulating the medium released at the medium-release position; and a regulation section having portions located on both sides of each sub-accumulating wheel on a downstream side of the outer surface of the accumulating wheel where the groove portion is located when the accumulating wheel is in the medium release position, said regulation section being disposed at a position crossing a surface of the groove portion including a trace of a rotational movement of the groove portion to remove from the groove portion the medium released at the medium release position, said regulation section being formed so as to leave the position crossing the surface when accumulated media are transferred in a batch from the medium-accumulating section.

22. A medium-reserving apparatus for receiving and reserving at least one individually transferred medium and discharging reserved media in a batch, comprising:

an accumulating wheel having an outer surface, and a groove portion opened in the outer surface adapted to receive a tip of a medium for holding, said accumulating wheel being rotated from a medium standby position to a medium release position;

a clamper formed in the accumulating wheel adapted to clamp the tip of the medium introduced into the groove portion and to release the medium at the medium release position;

a medium-accumulating section formed outside the accumulating wheel for accumulating the medium released at the medium-release position; and a gate situated near the accumulating wheel, said gate imposing toward the accumulating wheel a pressure on the medium released in the medium release position, and shutting off a transfer path to prevent the media from entering back to the accumulating space after accumulated media have been transferred in a batch.

23. A medium-reserving apparatus according to claim 22, further comprising thickness detection means for detecting a position of the gate to detect the thickness of the batch of the media accumulated in the medium-accumulating space.

24. A medium-reserving apparatus according to claim 23, wherein said thickness detection means stops a medium-accumulating operation when the thickness of the media reaches a predetermined value.

* * * * *

UNITED STATES PATENT AND TRADEMARK OFFICE

CERTIFICATE OF CORRECTION

PATENT NO. : 6,019,209

DATED : February 1, 2000

INVENTOR(S) : Toshio Hara, et al

It is certified that error appears in the above-identified patent and that said Letters Patent is hereby corrected as shown below:

In column 1, line 33, change "26(a) and 26(b)" to --26(A) and 26(B)--;

In column 2, line 36, change "roller" to --belt--;

In column 7, line 3, delete "25";

In column 11, lines 1, 23 and 41, change "dampers" to --clampers--, respectively;

line 11, change "lib" to --11b--;

line 34, change "damper" to --clamper--;

In column 13, line 61, delete "25";

In column 14, lines 29 and 36, change "dampers" to --clampers--, respectively;

In column 16, line 35, delete "section"; and

UNITED STATES PATENT AND TRADEMARK OFFICE

CERTIFICATE OF CORRECTION

PATENT NO. : 6,019,209

DATED : February 1, 2000

INVENTOR(S) : Toshio Hara, et al

It is certified that error appears in the above-identified patent and that said Letters Patent is hereby corrected as shown below:

In column 17, lines 62 and 63, change "groove section" to --groove portion--, respectively.

Signed and Sealed this

Twenty-eighth Day of November, 2000

*Attest:*

Q. TODD DICKINSON

*Attesting Officer*

*Director of Patents and Trademarks*